US008418980B2

(12) United States Patent
Wakura

(10) Patent No.: US 8,418,980 B2
(45) Date of Patent: Apr. 16, 2013

(54) SUSPENDING UNIT AND MEDIUM HOLDING MEMBER USED FOR THE SAME

(75) Inventor: Hiroshi Wakura, Ichikawa (JP)

(73) Assignee: Wayo Co., Ltd, Tokyo (JP)

( * ) Notice: Subject to any disclaimer, the term of this patent is extended or adjusted under 35 U.S.C. 154(b) by 335 days.

(21) Appl. No.: 12/922,099

(22) PCT Filed: Mar. 3, 2009

(86) PCT No.: PCT/JP2009/053921

§ 371 (c)(1),
(2), (4) Date: Sep. 10, 2010

(87) PCT Pub. No.: WO2009/113424

PCT Pub. Date: Sep. 17, 2009

(65) Prior Publication Data

US 2011/0006177 A1 Jan. 13, 2011

(30) Foreign Application Priority Data

Mar. 11, 2008 (JP) ..... 2008-060748

(51) Int. Cl.
*A47H 1/10* (2006.01)

(52) U.S. Cl.
USPC ..... 248/328; 40/601; 40/606.01; 40/617; 248/320

(58) Field of Classification Search ..... 40/601, 40/606.01, 606.14, 611.05, 617; 248/549, 248/328, 320
See application file for complete search history.

(56) References Cited

U.S. PATENT DOCUMENTS

| | | | | |
|---|---|---|---|---|
| 5,188,332 | A * | 2/1993 | Callas | 248/544 |
| 5,381,991 | A * | 1/1995 | Stocker | 248/206.5 |
| 6,859,146 | B2 * | 2/2005 | McGreal et al. | 340/693.6 |
| 7,373,748 | B2 * | 5/2008 | Pitcher et al. | 40/658 |
| 7,722,100 | B2 * | 5/2010 | Suciu et al. | 294/211 |
| 7,743,541 | B2 * | 6/2010 | Suciu et al. | 40/658 |
| 2002/0079412 | A1 * | 6/2002 | Pitlor | 248/206.5 |
| 2005/0055862 | A1 * | 3/2005 | Pitcher et al. | 40/658 |
| 2005/0097800 | A1 * | 5/2005 | Pitcher et al. | 40/658 |
| 2006/0196091 | A1 * | 9/2006 | Ricci et al. | 40/601 |

FOREIGN PATENT DOCUMENTS

| | | | |
|---|---|---|---|
| JP | 43-15218 | U | 6/1968 |
| JP | 60-64882 | U | 5/1985 |
| JP | 05-45762 | U | 6/1993 |
| JP | 3025925 | U | 4/1996 |
| JP | 3034649 | U | 12/1996 |

* cited by examiner

*Primary Examiner* — Bradley Duckworth
(74) *Attorney, Agent, or Firm* — Sughrue Mion, PLLC

(57) ABSTRACT

A suspending unit and a medium holding member used therefor, which suspending unit enables the installation and removal operations of information displaying medium to be easily carried out even when the suspending unit is placed on a base such as an unreachable ceiling or wall, and can also firmly hold the information displaying medium.

14 Claims, 27 Drawing Sheets

19
19
19

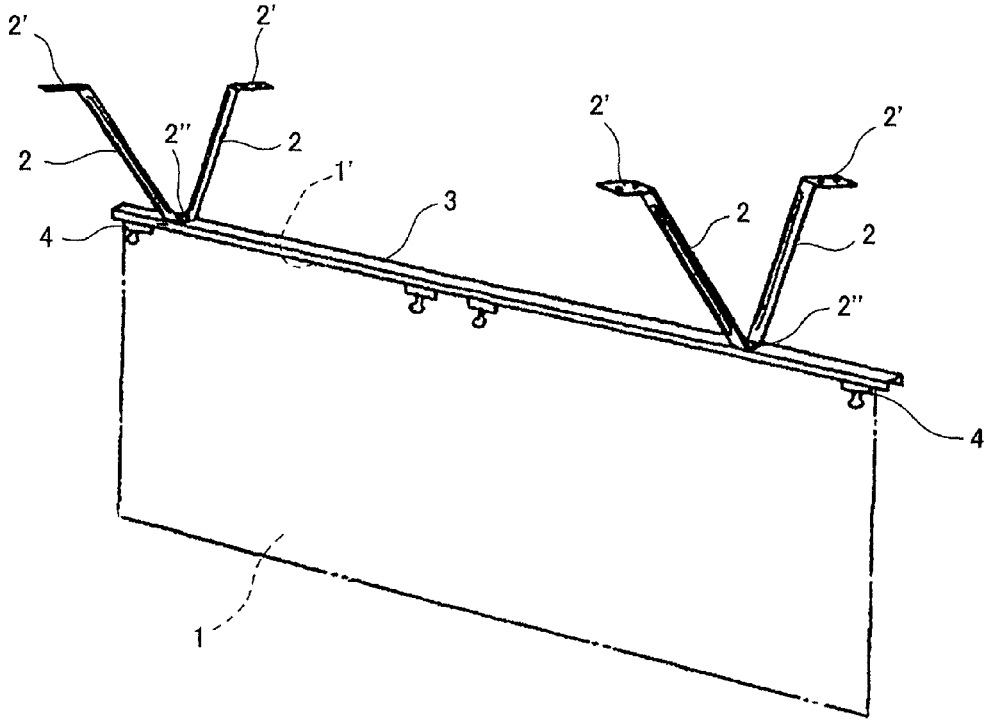
FIG. 27 (A) Prior Art
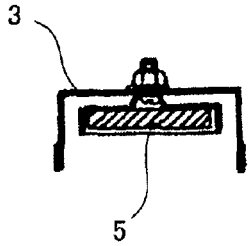
FIG. 27 (B) Prior Art

SUSPENDING UNIT AND MEDIUM HOLDING MEMBER USED FOR THE SAME

TECHNICAL FIELD

The present invention relates to a suspending unit for suspending an information displaying medium from a base, such as a ceiling member made of gypsum board or the like, and to a medium holding member used for the same.

BACKGROUND ART

A conventional suspending unit is disclosed in Patent Document 1. Shown in FIGS. 27(A) and (B) are drawings explaining the principal parts of the suspending unit in Patent Document 1.

The suspending unit according to Patent Document 1 is constituted in such a manner that a metal supporting arm 2, which has a V-shape when viewed from the side and a dimension which can position the upper edge 1' of an advertising medium 1 to be suspended at a certain distance from the position of the ceiling inside the store, is attached to the vicinity of both ends of the top surface of a medium suspending frame 3 having a width dimension substantially the same as or similar to that of the advertising medium 1, and that, in addition to this, a medium attachment body 4 is provided in the vicinity of the upper edge 1' of the advertising medium 1, which medium attachment body 4 can be joined with the above-described medium suspending frame 3 by a magnet 5.

[Patent Document 1] Japanese Utility Model S63-144671 A

DISCLOSURE OF THE INVENTION

Problems to be Solved by the Invention

However, in the suspending unit described in the above-described Patent Document 1, since the medium attachment body 4 provided in the vicinity of the upper edge 1' of the advertising medium 1 and the medium suspending frame 3 are joined by the magnet 5, there is a problem in that the advertising medium 1 easily falls off when the downward force on the advertising medium 1 exceeds the magnetic force of the magnet 5.

Further, in cases where the suspending unit is suspended from an unreachable high ceiling or the like, for example, a step ladder or the like must be used to install and remove the advertising medium, making such operation troublesome.

In view of the above, an object of the present invention is to provide a suspending unit and a medium holding member used therefor, which suspending unit enables the installation and removal operations of information displaying medium to be easily carried out even when the suspending unit is placed on a base such as an unreachable ceiling or wall, and can also firmly hold the information displaying medium.

Means for Solving the Problems

In order to achieve the above-described object, in a suspending unit according to the present invention for suspending an information displaying medium expressing a required information from a base, which suspending unit comprises a main body which is fixed on the aforementioned base and a suspending body which suspends the aforementioned information displaying medium and is supported by the main body in a freely detachable fashion; the main body being configured with a suspending body holding section which prevents downward movement of the suspending body and hold the suspending body in a freely detachable fashion: one or plural magnetic bodies are arranged facing the suspending body held by the suspending body holding section; the suspending body being arranged with other magnetic bodies at positions where these magnetic bodies face the aforementioned magnetic bodies arranged on the main body, the magnetic bodies attaching to each other: and a detachment part is configured in such a manner to effect an external force against the magnetic attraction force between the magnetic bodies arranged on the main body and the suspending body, so that the suspending body is detached from the suspending body holding section.

In order to achieve the above-described object, a medium holding member used in the suspending unit according to the present invention is arranged with a pair of flexible pieces facing each other and a fixed piece therebetween with a required space between each of the flexible piece and the fixed piece, which flexible pieces are movable between a clamping position where an information displaying medium is clamped and a non-clamping position where the information displaying medium is not clamped: and a plurality of clamping projections are protrudedly arranged on each of the surfaces of the flexible pieces and the fixed piece facing each other, which clamping projections are used to clamp the information displaying medium.

Effects of the Invention

According to the present invention, the installation and removal operations of information displaying medium can be easily carried out even when the suspending unit is placed on a base such as an unreachable ceiling or wall. Further, the information displaying medium can be also firmly held.

BRIEF DESCRIPTION OF THE DRAWINGS

FIGS. 27(A) and (B) are drawings explaining the principal parts of the suspending unit disclosed in Patent Document 1.

BEST MODE FOR CARRYING OUT THE INVENTION

Figure 1:
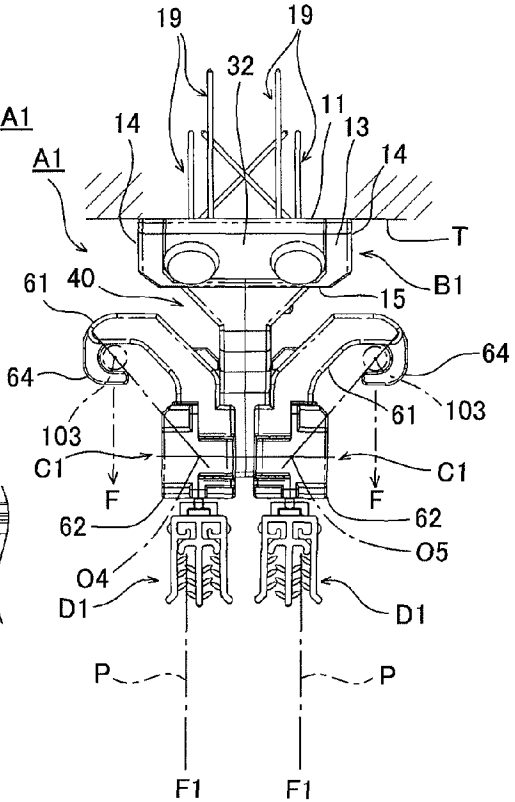
FIG. 1 illustrates the suspending unit relating to the first embodiment of the present invention, with (A) and (B) showing its front view and side view, respectively.
Figure 1:
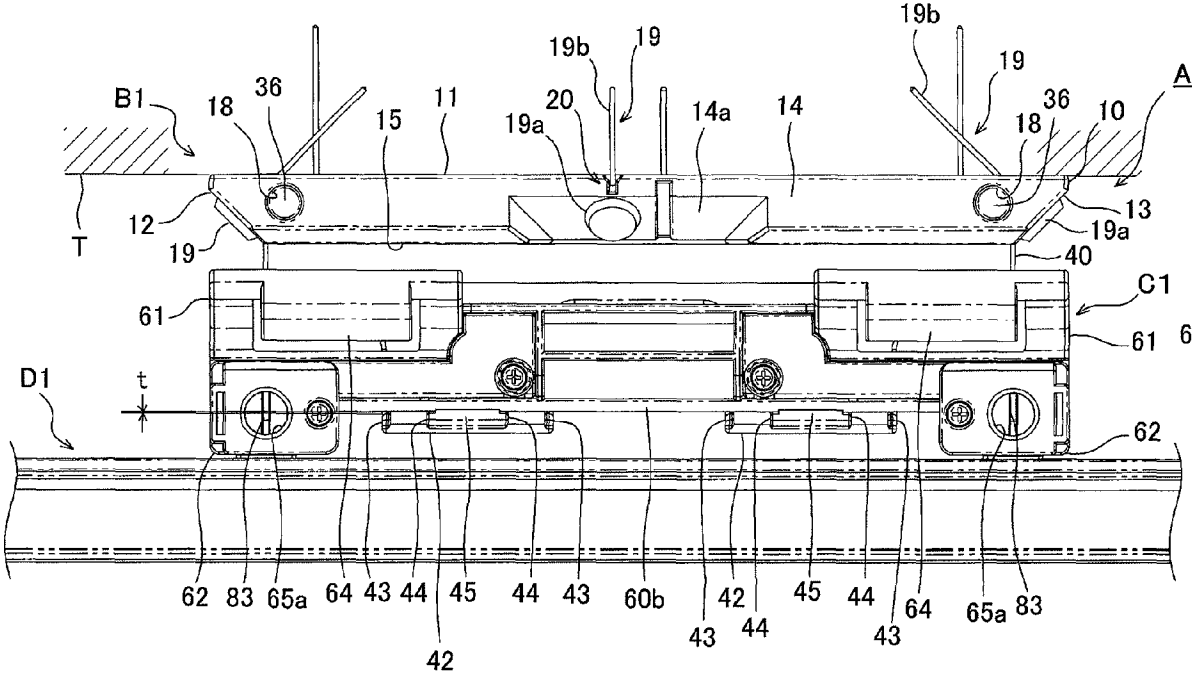
Figure 2:
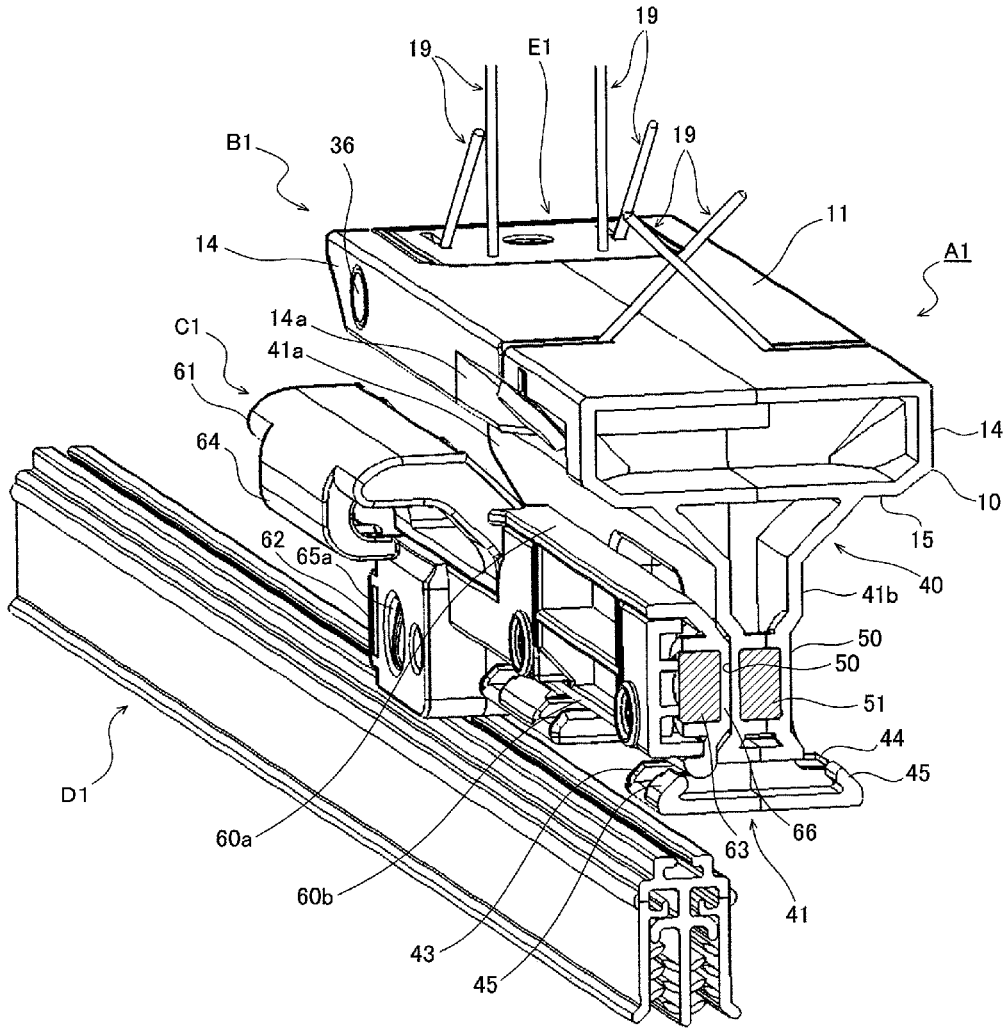
FIG. 2 is a perspective view showing the cross-section of the same suspending unit.
Figure 3:
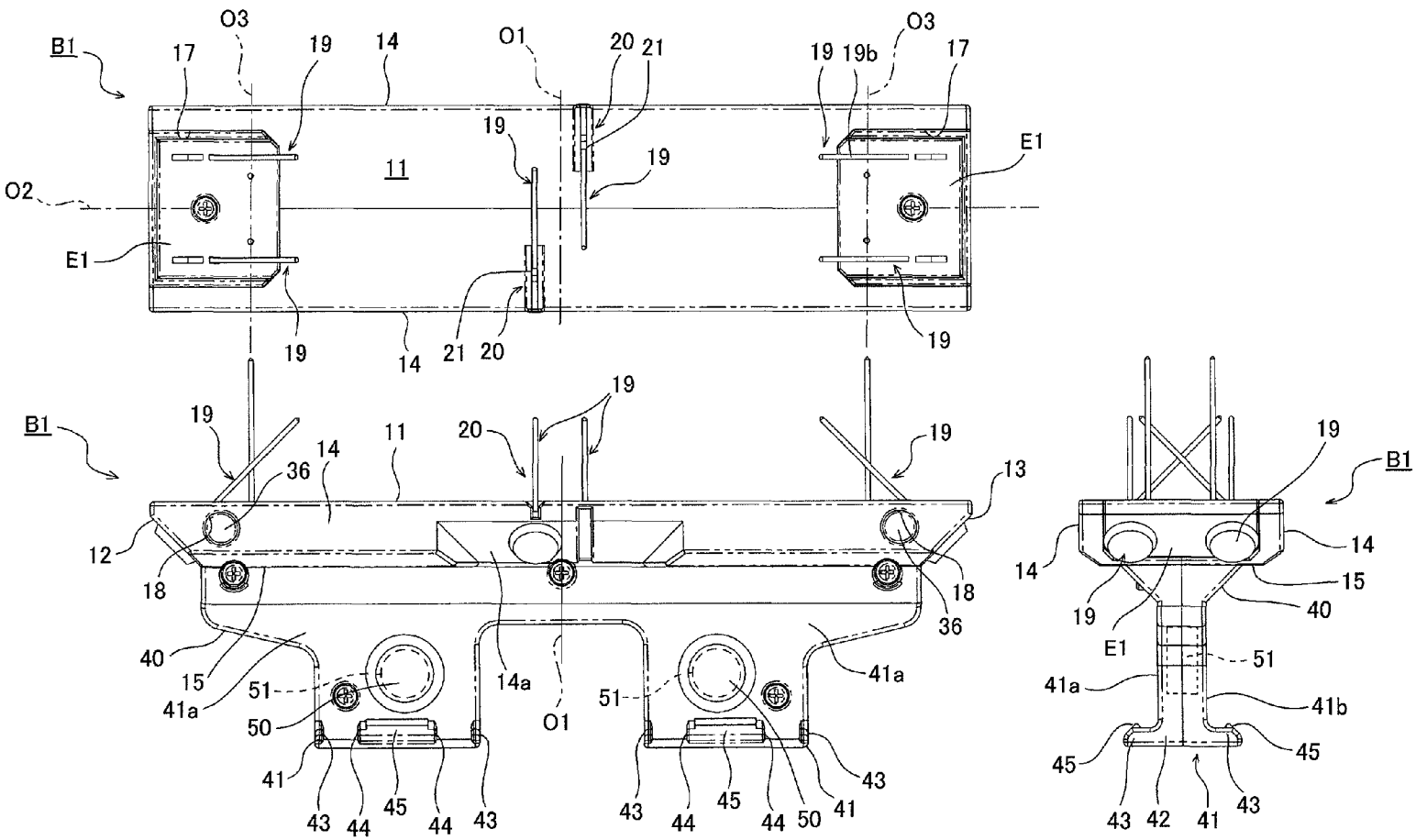
FIG. 3 shows the main body constituting a part of the same suspending unit. Shown in FIGS. 3(A), (B) and (C) are the main body's plan view, front view and side view, respectively.
Figure 4:
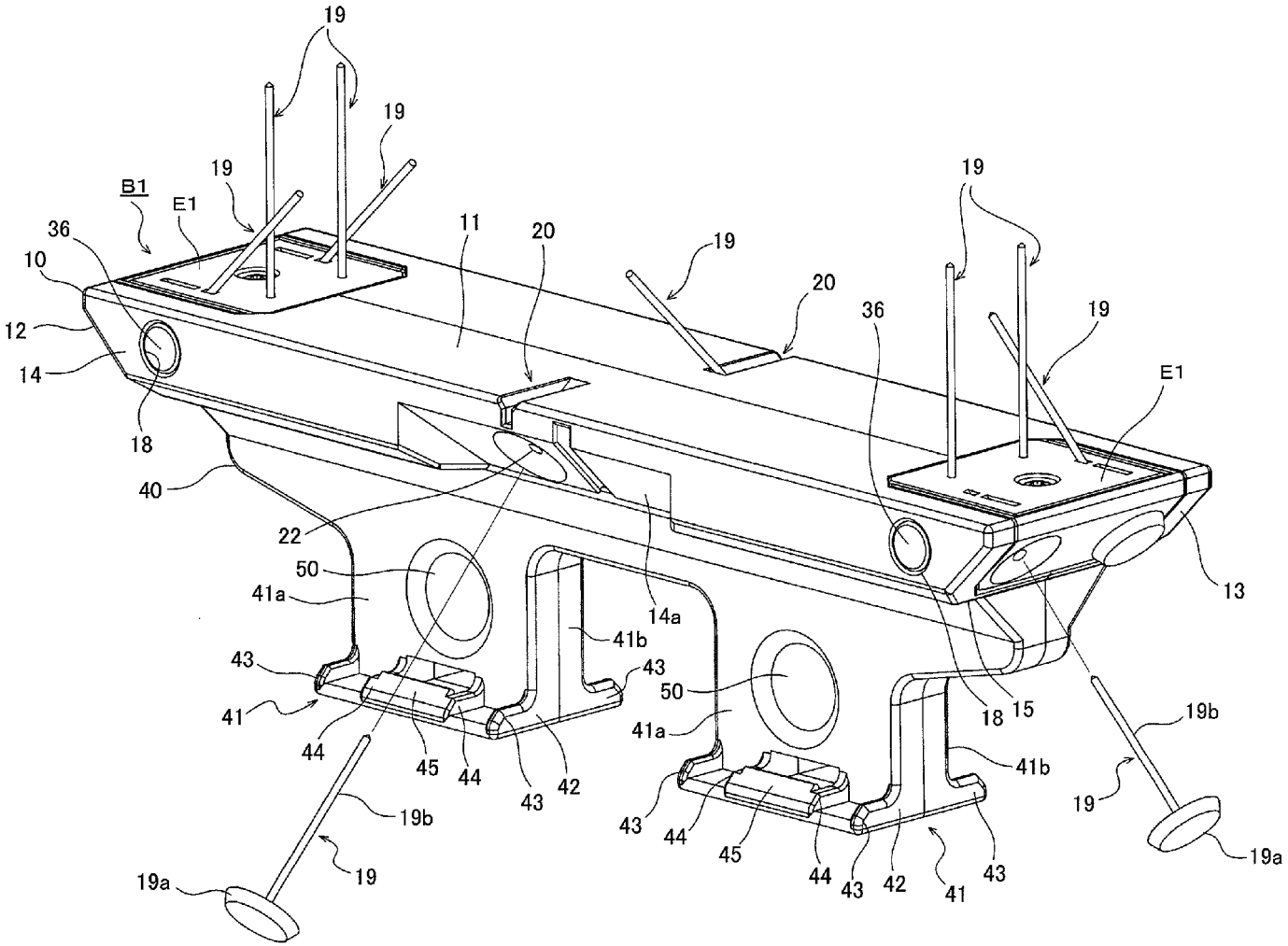
FIG. 4 is a perspective view of the main body constituting a part of the same suspending unit.

The modes for carrying out the present invention will now be described referring to the drawings. FIG. 1 represents the suspending unit according to the first embodiment of the present invention. FIG. 1(A) shows a front view of the suspending unit and FIG. 1(B) shows one of the side views of the suspending unit. FIG. 2 is a perspective view showing a longitudinal section of the suspending unit and FIG. 3 shows the main body constituting a part thereof. Shown in FIGS. 3(A), (B) and (C) are the main body's plan view, front view and side view, respectively. FIG. 4 is a perspective view of the main body.

The suspending unit A1 according to the first embodiment of the present invention is used to suspend an information displaying medium P from, for example, a base T (see FIG. 1) such as a ceiling or wall made of gypsum board, and is principally constituted by a main body B1, suspending body C1 and medium holding members D1, D1.

The information displaying medium P refers to an advertisement paper or the like displaying required information such as product name, price, catch phrase and the like.

The main body B1 according to one example comprises a base 10 having a required thickness and a substantially rectangular parallelepiped shape and a suspending body holding section 40 integrally and vertically arranged on the base 10. The main body B1 is made of, for example, a synthetic resin such as polypropylene.

The base 10 has a hollow configuration which is compartmentally formed by a top wall surface 11 having a rectangular shape when planarly viewed; wall surfaces 12 and 13 slantly formed at both ends; front and back wall surfaces 14, 14; and a bottom wall surface 15.

At the both ends of the base 10, from each of the wall surfaces 12 and 13 to the top wall surface 11, there are formed openings 17, 17 having a U-shape when planarly viewed.

In addition, formed on the wall surfaces 14, 14 are the later-described fixing attachment E1*s* interfitted with the openings 17, 17; and as the positioning parts for positioning the E1*s*, positioning holes 18, 18 having a circular shape when viewed from the front. Here, the positioning parts are not restricted to the above-described hole shape, and they may be provided by forming the wall surfaces in an irregular shape.

At positions on both sides close to a halving line O1 (see FIG. 3) which splits the base 10 into two between the both ends, pin-engaging parts 20, 20, each of which allows the later-described securing pin 19 to be engaged into the base T in an insertable fashion, are slantly arranged at a required angle.

The pin-engaging parts 20 are formed as pin-engaging holes, whose upper opening 21 is arranged in the vicinity of the side-edge of the top wall surface 11 and a lower opening 22 (see FIG. 4) is arranged on each of the wall surfaces 14, 14 (one of these is not shown).

The "required angle" is 45° in this embodiment; however, it may be adjusted considering the shape, size and the like of the base 10.

At the center of the above-described wall surfaces 14, 14, transversely elongated recesses 14*a*, 14*a* (one of these is not shown) are formed so that knob 19*a* of the later-described securing pin 19 does not protrude in the longitudinal direction.

As shown in FIGS. 1 to 4, the securing pin 19 has the knob 19*a* attached to the base end of a pin member 19*b*, and the tip of the pin member 19*b* is sharpened so that it can be easily inserted into the base T.

The total length of the pin member 19*b* is set in such a manner that only a required length thereof is inserted into the base T when the knob 19*a* is brought into contact with the wall surfaces 14, 14 of the main body B.

Here, since the later-described positioning pins have the same constitution as the securing pin 19, detailed descriptions thereof are omitted by allocating the same symbols used for the securing pin.

Figure 5:
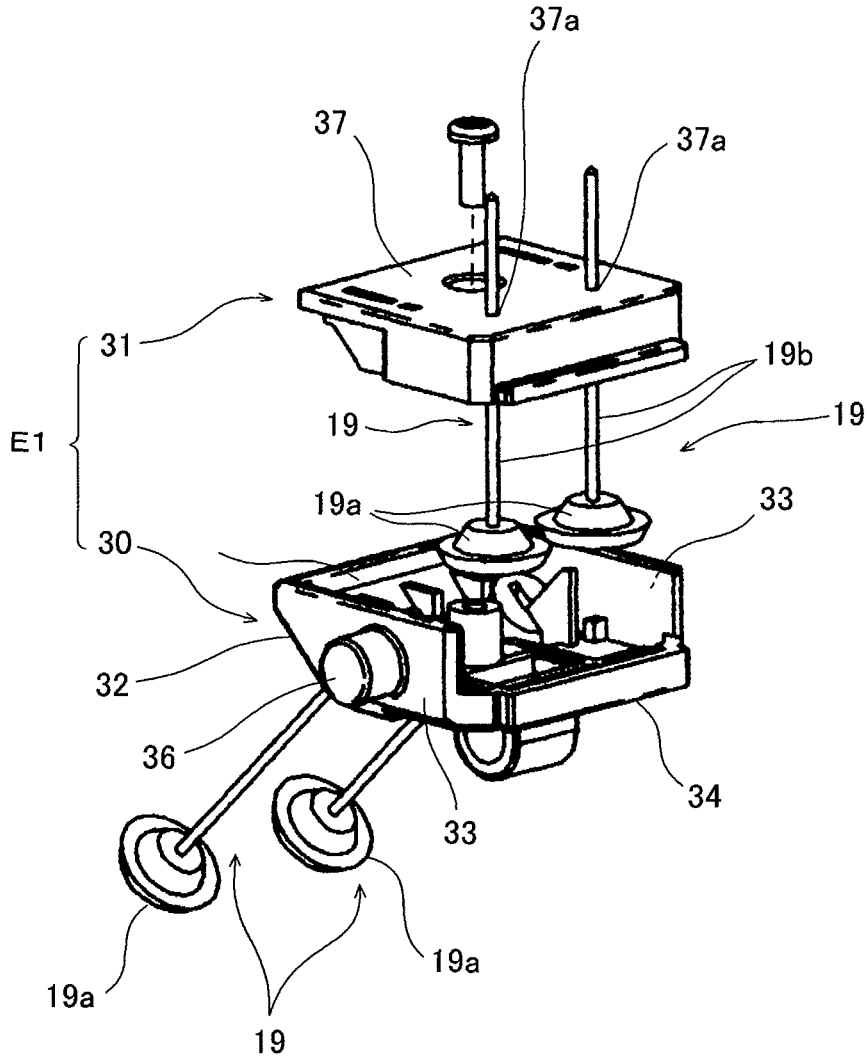
FIG. 5 is an enlarged exploded perspective view showing the fixing attachment according to one example.

FIG. 5 is an enlarged exploded perspective view showing the fixing attachment according to one example.

The fixing attachment E1 is interfitted with the opening 17 in a detachable fashion and is constituted by an attachment main body 30 and a cover part 31.

The attachment main body 30 is, when interfitted with the above-described openings 17, 17, compartmentally formed by a slanted wall surface 32 flushed with the above-described wall surfaces 12, 13 of the base 10; wall surfaces 33, 33 inscribed with the wall surfaces 14, 14 of the base 10; and a bottom wall surface 34, and has a substantially rectangular parallelepiped shape whose the top surface is an interfitting opening 35 to which the cover part 31 is interfitted.

On the wall surfaces 33, 33, cylindrical positioning processes 36, 36 having only a required length of projection are formed at positions at which the positioning processes 36, 36 face the above-described positioning holes 18, 18 when the fixing attachment E1 is interfitted with the base 10.

The cover part 31 is a platy body which has a substantially square shape when planarly viewed and is interfitted with the above-described interfitting opening 35. Formed on the top surface 37 of the cover part 31 are pin-engaging holes 37*a*, 37*a* into which the positioning pins 19, 19 are each vertically engaged.

The pin-engaging holes 37*a*, 37*a* are used to engage thereinto the positioning pins 19 in order to position the main body B1 on the base T. The pin-engaging holes 37*a*, 37*a* are formed on axes O3, which are perpendicular to the central axis O2 (see FIG. 3) of the main body B1, with a space between each other in an upright manner with respect to the top surface 37.

By arranging the above-described pin-engaging holes 37*a*, 37*a* on the axes O3, the main body B1 can be firmly positioned on the base T only by inserting the positioning pins 19, 19 engaged into the pin-engaging holes 37*a*, 37*a* into the base to bring the top surface 37 into contact with the base.

Further, by arranging two positioning pins 19, 19, displacement of the main body B1 when inserting the securing pins 19 into the base T can be prevented.

A suspending body holding section 40 is provided to prevent the downward movement of the suspending body C1 according to one example and to hold the suspending body C1 in a freely detachable fashion. As required, two suspending bodies C1, C1 can be aligned and simultaneously held in such a manner that they face each other. The details thereof are as follows.

This suspending body holding section 40 is arranged on the bottom wall surface 15 of the base 10 in conformity to the central axis O2 with a pair of leg portions 41, 41 that are pendulously formed, and is configured in a transversely elongated inverted U-shape when viewed from the front. In other words, the suspending body holding section 40 has a substantially gate shape.

As shown in FIGS. 3 and 4, the leg portions 41 are configured in a transversely elongated rectangle shape when viewed from the front. On the bottom end of each leg portion 41, there is formed a fall-off preventing piece 42 having horizontal projections to the front and back from the front and back surfaces 41*a*, 41*b* of the leg portion 41 at an amount corresponding to the thickness of a basal body 60 of the suspending body C1, which is described later in detail.

At the margin of the top surface of both sides of the fall-off preventing piece 42, contact pieces 43, 44, 44, 43, which contact the suspending body C1, are arranged at required intervals, and a locking nail 45 having a dimension higher than the contact pieces 43, 44 is formed between the tips of the contact pieces 44, 44.

The locking nails 45, 45 are positioned in such a manner that the suspending body C1 held by the suspending body holding section 40 is inserted between and brought into contact with the front and back surfaces 41*a*, 41*b* of the leg portion 41, thereby having a function to prevent the suspending body C1 from falling off.

On the front and back surfaces 41*a*, 41*b* of each leg portion 41, positioning parts for positioning the suspending body C1 are formed facing the opposite directions as positioning recesses 50, 50, which have a circular shape when viewed from the front. Internally arranged between the positioning recesses 50, 50 are magnetic bodies 51, 51.

The magnetic body 51 is a discoid magnet in this embodiment; however, it may be an electromagnet, and it does not have to be internally arranged and may be exposed to the front and back surfaces of 41*a*, 41*b* of each leg portion 41. Further, the constitution may be one in which a tape-form magnetic body is affixed onto the front and back surfaces 41*a*, 41*b* of each leg portion 41.

Figures 6A, 6B, 6C:
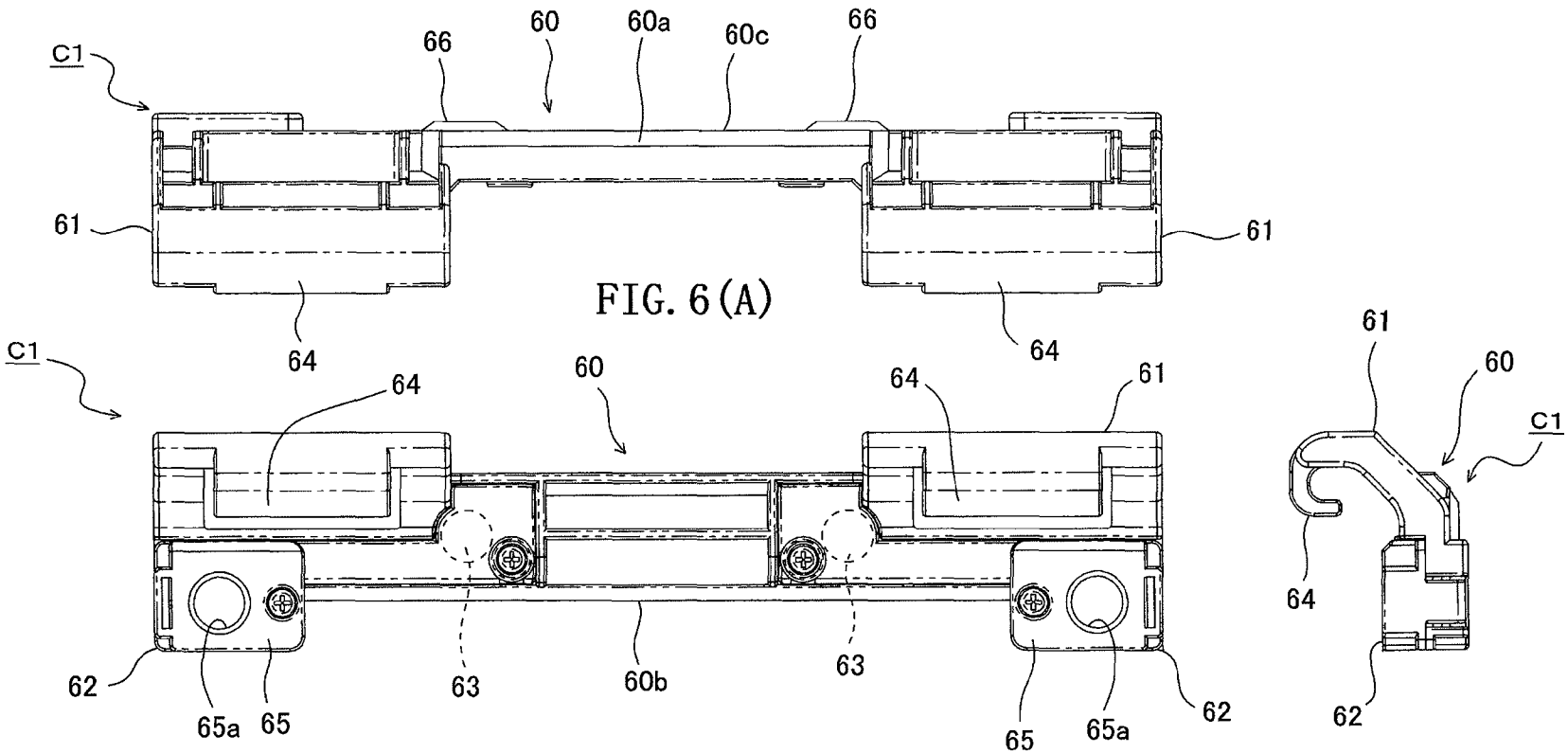
FIGS. 6(A), (B) and (C) are a plan view, a front view and a side view of the suspending body, respectively.
Figure 7:
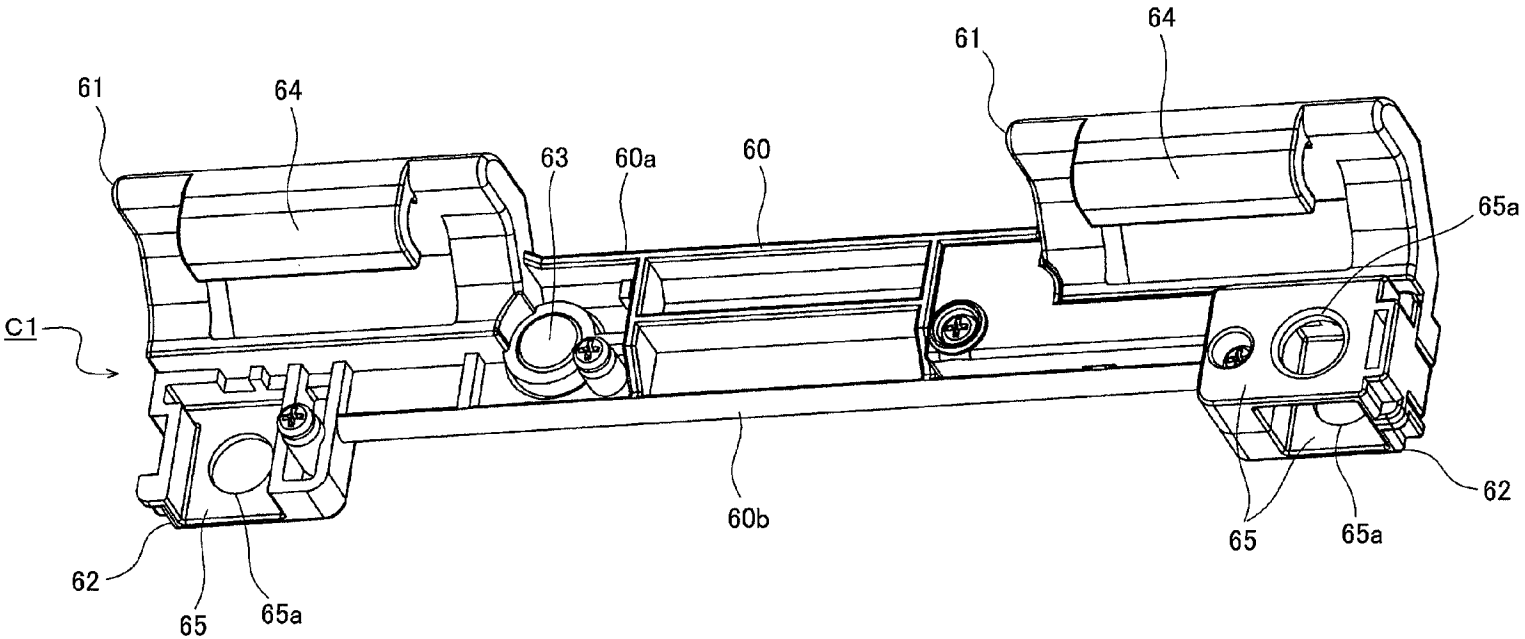
FIG. 7 is a perspective view viewing the suspending body from the front.

Next, the suspending body C1 according to the first example will be described. Shown in FIGS. 6(A), (B) and (C) are a plan view, a front view and a side view of the suspending body, respectively. FIG. 7 is a perspective view viewing the suspending body from the front. Here, in order to show the internal structure, FIG. 7 is shown with some of the members shown in FIG. 6 removed.

The suspending body C1 according to the first example is constituted by the basal body 60 which is a transversely elongated rectangular shape; detachment parts 61, 61 which are arranged on both ends of upper edge 60*a* of the basal body 60; connectors 62, 62 which are arranged on both ends of the lower edge 60*b* of the basal body 60; and magnetic bodies 63, 63.

The detachment parts 61, 61 function to allow an external force to effect against the magnetic attraction force between the magnetic bodies 51 and 63 arranged on the main body B1 and suspending body C1, respectively, so that the suspending body C1 is detached from the suspending body holding section 40.

Specifically, the detachment parts 61, 61 are used in the installation and removal operations of the suspending body C1 to and from the main body B1 carried out by a replacing equipment 100 which is later described in detail. Formed on the detachment parts 61, 61 are laterally J-shaped locking pieces 64, 64 having a lateral rectangular shape when viewed from the front, which locking pieces 64, 64 are used to insert and lock a locking bar 103 (see FIG. 9) of the replacing equipment 100 at the upper end of the detachment parts 61, 61.

That is, as shown in FIG. 1(B), the above-described locking pieces 64, 64 are positioned in such a manner that, by at least effecting an external force in the downward direction (downward external force) F, rotary forces in the clockwise and the counter-clockwise directions are generated on the suspending bodies C1, C1 with the contact points between the above-described contact pieces 43, 44, 44, 43 and the lower edge 60*b* of the basal body 60 of the suspending body C1 as the rotation axes O4, O5.

The connectors 62, 62 connect and hold, in a freely detachable fashion, the medium holding member D1 according to the first embodiment which is described later in detail, and they are configured in a square-frame shape when planarly viewed, comprising front and back walls 65, 65 where bearing holes 65*a*, 65*a* are formed. In addition, the lower surfaces of the connectors 62, 62 have openings which serve as connecting openings.

On the back surface 60*c* of the basal body 60, positioning parts interfitting with the above-described positioning recesses 50, 50 are formed as positioning protruded portions 66, 66 having a circular shape when viewed from the front, and on the front surface on these positioning protruded portions 66, 66, there are fixed suspending body-side magnetic bodies 63, 63 having the same shape and size as the above-described main body-side magnetic bodies 51, 51.

That is, while the above-described main body B1 is arranged with two main body-side magnetic bodies 51, 51 at positions where they face the suspending body C1 held on the suspending body holding section 40, the suspending body C1 is arranged with the suspending body-side magnetic bodies 63, 63 at positions where they face the respective main body-side magnetic bodies 51, 51, which suspending body-side magnetic bodies 63, 63 attach to the main body-side magnetic bodies 51, 51.

In this embodiment, the two main body-side magnetic bodies 51, 51 on the side of the main body B1 are arranged in such a manner that magnetic poles different from each other face the suspending body C1, and the two suspending body-side magnetic bodies 63, 63 on the side of the suspending body C1 are arranged in such a manner that the magnetic poles face different from each other the side of the main body B1, so that the two main body-side magnetic bodies 51, 51 on the side of the main body B1 and the two suspending body-side magnetic bodies 63, 63 on the side of the suspending body C1 are attached to each other.

Whereby, one suspending body C1 can be commonly held against the suspending body holding sections 40, 40 formed on the both front and back surfaces 41*a*, 41*b* of the leg portions 41, 41.

Further, in this embodiment, when the positioning recesses 50, 50 are interfitted with the positioning protruded portions 66, 66, the lower edge 60*b* of the basal body 60 of the suspending body C1 and the contact pieces 43, 44, 44, 43 are positioned in such a manner that a required gap (t) (see FIG. 1) is formed therebetween.

Figure 8:
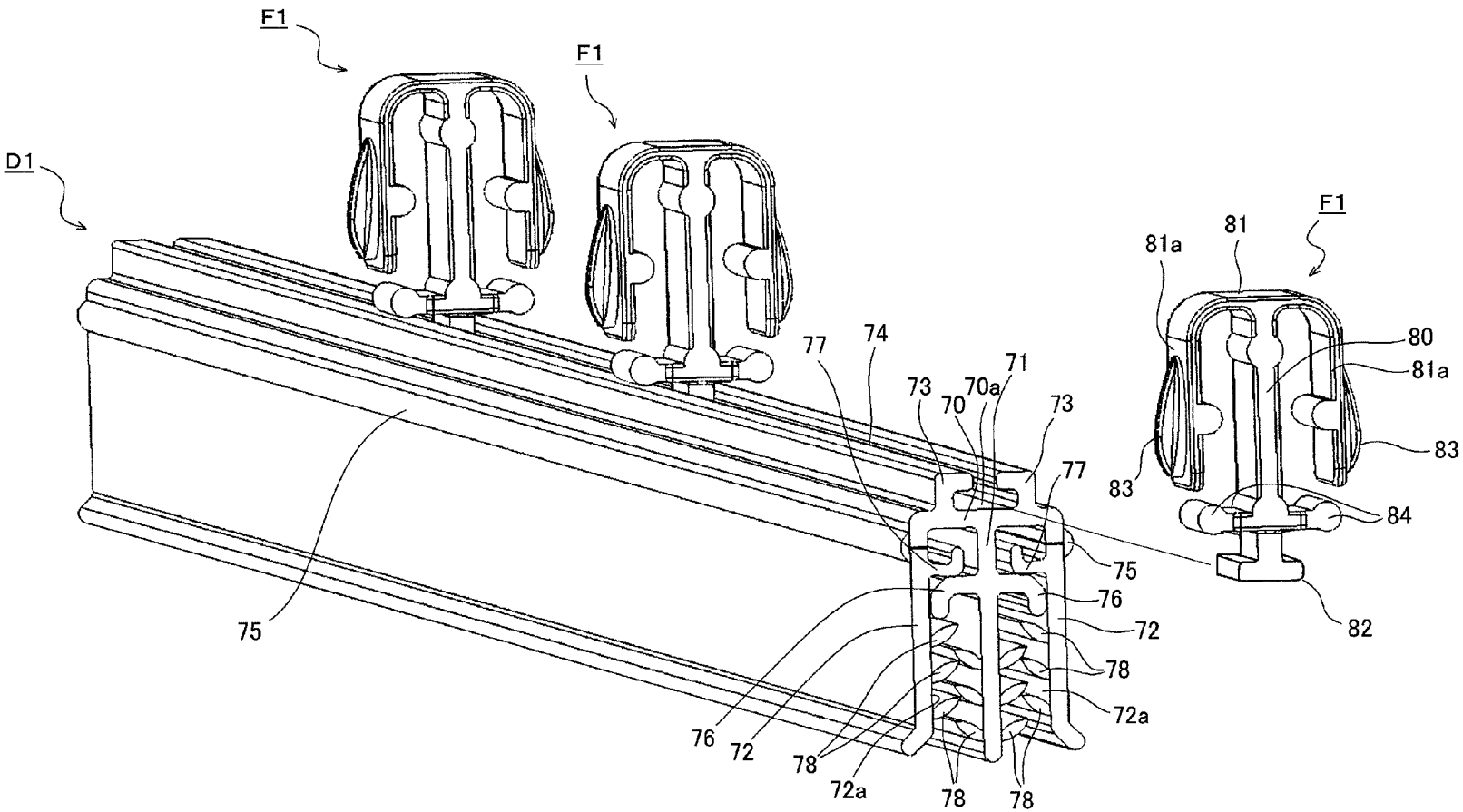
FIG. 8 is an enlarged perspective view showing the replacement bracket according to one example and the medium holding member which is suspended by the bracket.

FIG. 8 is an enlarged perspective view showing the bracket according to one example and the medium holding member according to the first embodiment which is suspended by the bracket. The medium holding member D1 according to the first embodiment is configured to have a total length corresponding to the width of the information displaying medium P and to be able to simultaneously hold two information displaying media P, P in the front and back. The structure of the medium holding member D1 is as follows.

The medium holding member D1 was obtained by integrally molding a synthetic resin and has a structure in which a fixed piece 71 is vertically arranged in the center of the bottom surface of a connecting piece 70 and flexible pieces 72, 72 are each vertically arranged on the front and back edges of the connecting piece 70. The medium holding member D1 is in a substantially inverted E-shape when viewed from the side.

On the top surface 70*a* of the connecting piece 70, an inserted-through groove 74 to which a connector 82 of a bracket F1 later described in detail is inserted through is compartmentally formed by a pair of erected pieces 73, 73 that are in an inverted L-shape.

Provided between the flexible piece 72 and the edge of the connecting piece 70 and is a hinge 75. The flexible piece 72 can be moved between the clamping position shown in FIG. 8 and a non-clamping position (not shown) where the flexible piece 72 is outwardly opened from the clamping position.

On the upper end of the inner surfaces 72*a*, 72*a* of the flexible pieces 72, 72, engaging projections 77, 77, which are engaged with engaging projections 76, 76 formed on the upper end of the fixed piece 71 when the flexible pieces 72, 72 are moved into the clamping position, are protrudedly formed toward the fixed piece 71.

In addition, protrudedly formed in multiple layer between the central part and the lower part of the flexible pieces 72, 72 are clamping projections 78 . . . for clamping the information displaying medium P.

The clamping projections 78 . . . are slantly arranged with the open ends positioned higher than the fixed ends, thereby increasing the clamping power by the weight of the information displaying medium P itself.

By allowing the engaging projections 76 and 77 to be engaged, not only the flexible piece 72 can be positioned and fixed at the clamping position, but also the information displaying medium P inserted between the clamping projections 78 . . . can be clamped firmly.

As shown in this embodiment, since two information displaying media P, P are individually held by the clamping projections 78 . . . , the frictional force can be increased compared to when two information displaying media P, P are clamped together, thereby allowing each information displaying medium P to be firmly clamped.

The bracket F1 is made of a synthetic resin and constituted by a supporting leg 80 to which two connectors 81, 82 are integrally formed on the upper and lower ends thereof. The connector 81 is configured in an inverted U-shape when viewed from the side, and protrudedly formed on the outer surface of dropping portions 81*a*, 81*a* thereof are locking projections 83, 83 locked to the connecting hole 65*a* of the above-described connector 62.

The dropping portions 81*a*, 81*a* are inwardly elastically deformed when locking the locking projections 83, 83 to the above-described connecting hole 65*a*, and by this elastic force, the locking projections 83, 83 are locked to the above-described connecting hole 65*a*.

The connector 82 is configured in a transversely elongated rectangular parallelepiped shape when viewed from the side and in such a manner that this connector 82 is inserted through the inserted-through groove 74. Indicated as 84, 84 are guide pieces.

Figure 9:
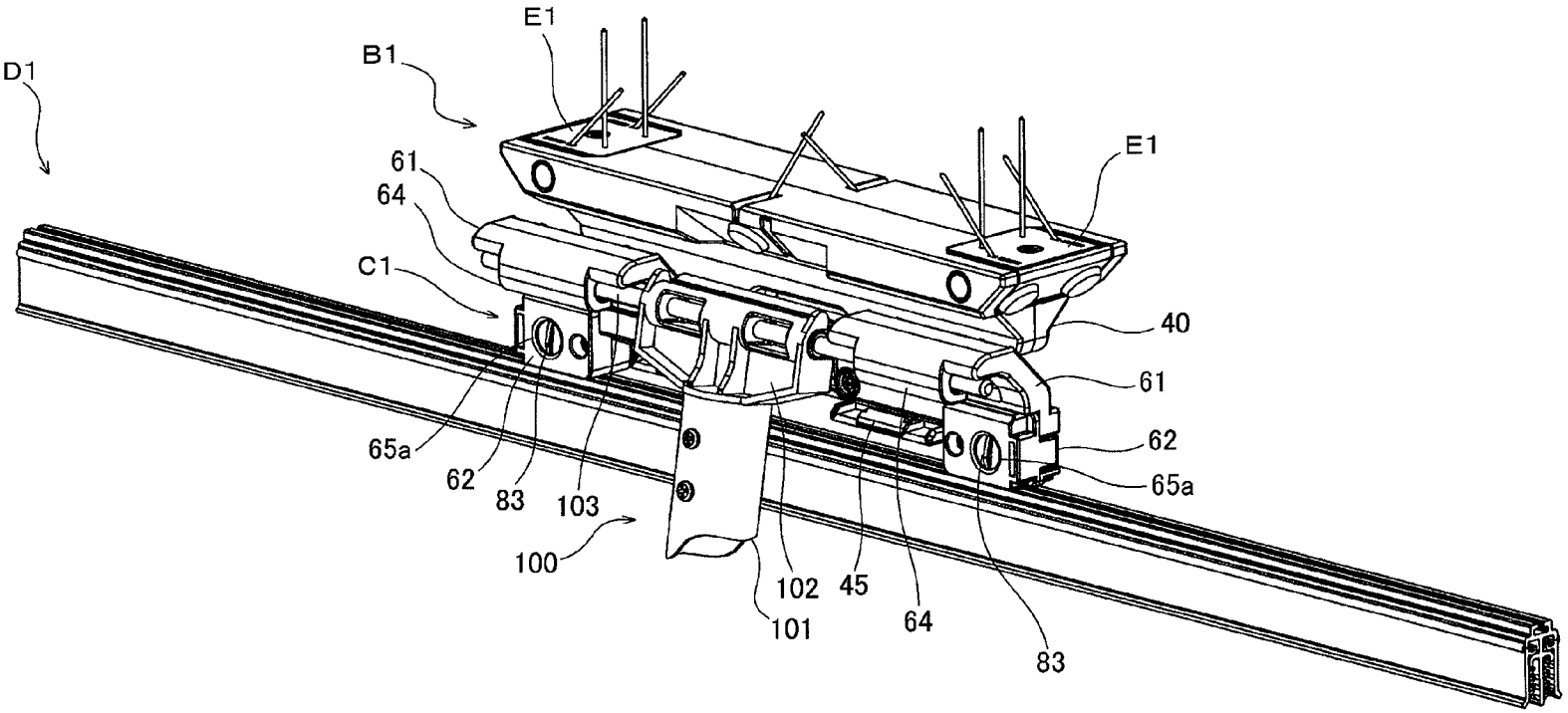
FIG. 9 is a perspective view showing the condition in which the replacing equipment is locked to the suspending body held by the main body.
Figure 10:
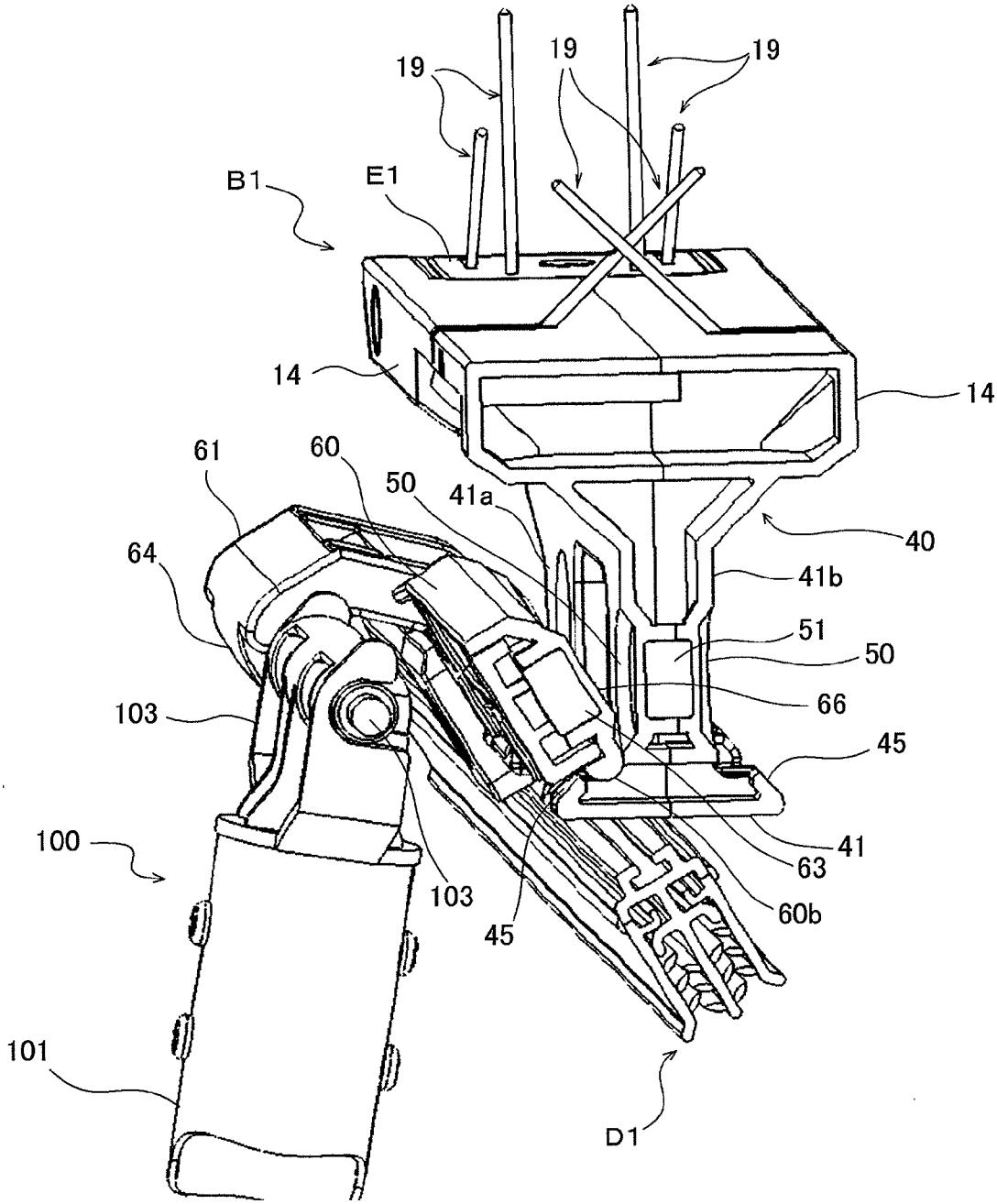
FIG. 10 is a cross-sectional perspective view when the suspending body is detached from the main body.
Figure 11:
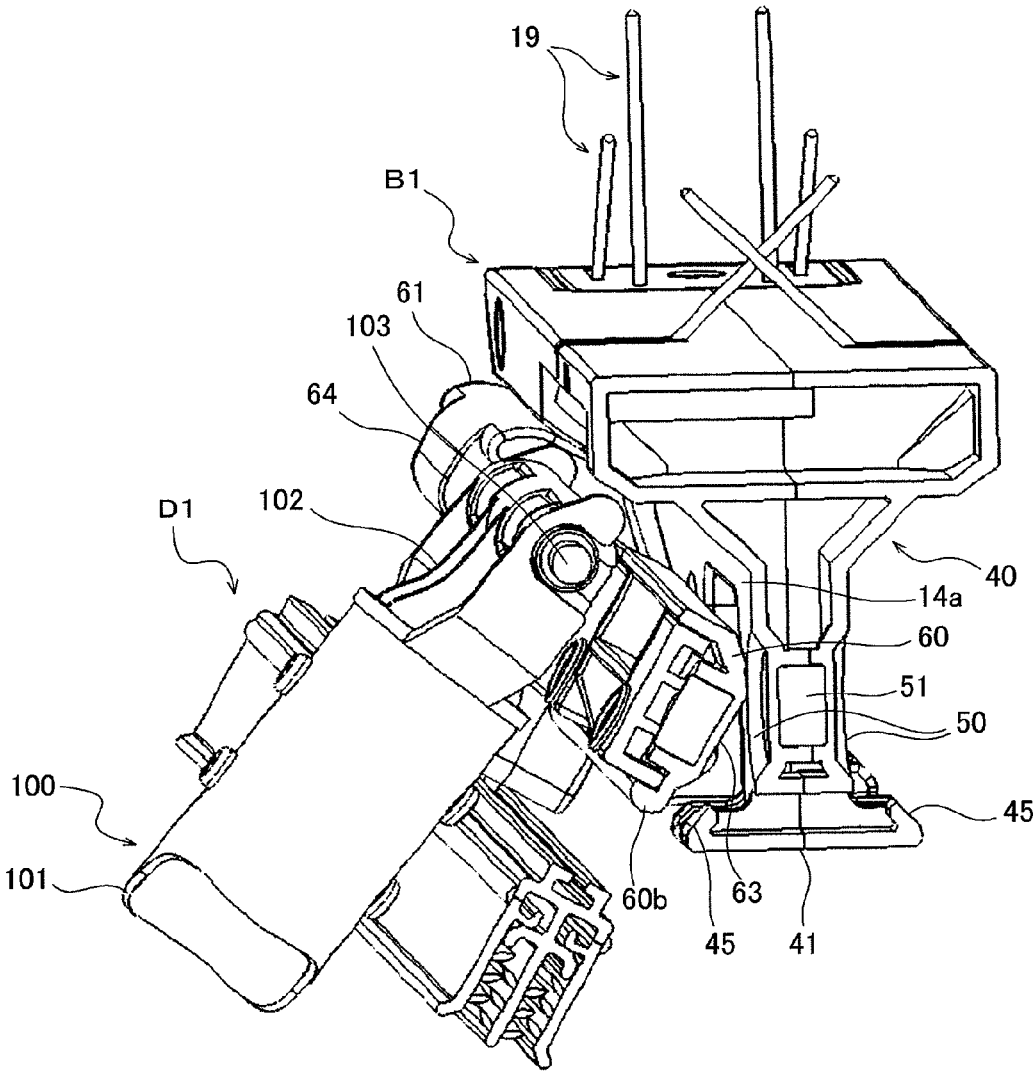
FIG. 11 is a cross-sectional perspective view when the suspending body is mounted onto the main body.

Using the suspending unit A1 according to the first embodiment having the above constitution, the operation to suspend an information displaying medium from a base and the operation to hang down the suspended information displaying medium will now be described. FIG. 9 is a perspective view showing the condition in which the replacing equipment is locked to the suspending body held by the main body, and FIG. 10 is a cross-sectional perspective view when the suspending body is detached from the main body. FIG. 11 is a cross-sectional perspective view when the suspending body is mounted onto the main body.

First, the operation to fix the main body B1 onto the base T will be described.

At a desired position of the base T, by approximating the top surface 11 of the main body B1 to the base T with the top surface 11 facing the base, the positioning pins 19 . . . begin to be inserted to the base T. At this time, the securing pins 19 . . . are not yet engaged into the main body B1.

When the top wall surface 11 of the main body B1 is allowed to contact the base T, the positioning pins 19 . . . are sufficiently inserted into the base T, so that the main body B1 can be firmly positioned on the base T.

Next, the securing pins 19 are pushed-in until the knob 19*a* is brought into contact with the wall surface. Whereby a required length of the pin member 19*b* is inserted to the base T at an angle of 45°, so that the suspending unit A1 can be firmly fixed onto the base T.

Also when the securing pins 19 are inserted to the base T, the main body B1 is firmly positioned and fixed onto the base T by the positioning pins 19, 19. Therefore, it is not required to restrain the main body B1 when inserting the securing pins 19 to the base T as well, so that the securing pins 19 can be easily inserted with one hand.

The replacing equipment 100 used in the operation to replace the suspending body C1 has a constitution in which the cylindrical locking bar 103 is fitted perpendicular to a handle 101 via a connecting equipment 102 which is fixed at the upper end of the handle 101 having a required total length.

The suspending body C1 is held at the suspending body holding section 40 by magnetic attraction force between the magnetic bodies 51 and 63, and the positioning recesses 50, 50 are interfitted with the positioning protruded portions 66, 66.

As shown in FIG. 9, by inserting and locking the locking bar 103 of the replacing equipment 100 to the locking pieces 64, 64, and by applying an external force F in such a manner to pull down the suspending body C1, the interfitted condition with the positioning protruded portions 66, 66 is released. Consequently, the suspending body C1 is moved in the downward direction by a length of the gap (t) (see FIG. 1(A)), thereby bringing the lower edge 60*b* of the basal body 60 of the suspending body C1 into contact with the contact pieces 43, 44, 44, 43.

At this time, the magnetic attraction force between the magnetic bodies 51 and 63 is drastically weakened, whereby the external force F for pulling down the suspending body C1 can be made small.

When the above-described external force F is continuously applied, the external force acts on the suspending body C1 in such a manner to dissociate the magnetic bodies 51 and 63 which are counter-adsorbing to each other. Consequently, a force to tilt the suspending body C1 centering at the lower edge 60*b* of the basal body 60 which is in contact with the contact pieces 43, 44, 44, 43 is generated, whereby the suspending body C1 is tilted centering at the lower edge 60*b* of the basal body 60 which is in contact with the contact pieces 43, 44, 44, 43.

In the process of the tilting of the suspending body C1, the lower edge 60*b* thereof is locked by the locking nail 45, thereby preventing the suspending body C1 from falling off during the detachment.

In this manner, the suspending body C1 is tilted and detached from the main body B1 against the magnetic attraction force between the magnetic bodies 51 and 63.

Further, as shown in FIG. 11, when mounting the suspending body C1 to the main body B1, by approximating the suspending body C1 to the main body B1 from the side of the upper edge 60*a* of the basal body 60 with the positioning parts 50, 50 and 63, 63 facing to each other, a magnetic attraction force is generated between the positioning parts 50, 50 and 63, 63, allowing the respective parts to interfit with each other.

Whereby the both edge directions of the main body B1 are determined, and the vertical direction is determined by the interfitting between the respective positioning parts 50, 50 and 63, 63.

Here, although the weight of the information displaying medium P itself works on the suspending body C1, since the point of action by the weight itself is located slightly inside the rotation axes O4, O5, a force to detach the suspending body C1 is not generated. In addition, since the magnetic attraction force between the magnetic bodies 51 and 63 is set at a sufficient level considering the weight of the information displaying medium P itself, downward displacement does not occur as well.

Figure 12:
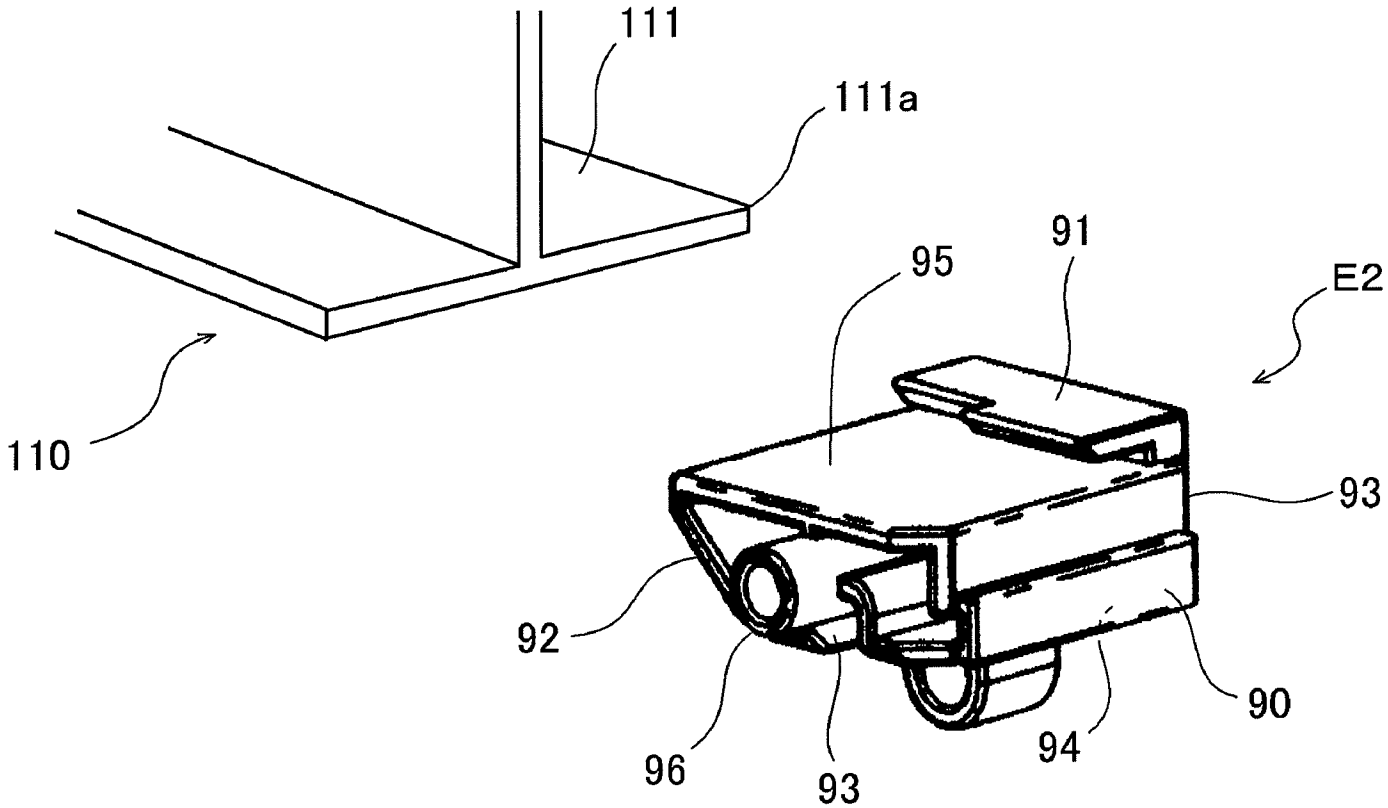
FIG. 12 is an enlarged outline perspective view showing the fixing attachment according to other examples.

Next, the fixing attachment according to other examples will be described referring to FIG. 12. FIG. 12 is an enlarged outline perspective view showing the fixing attachment according to other examples. The above-described fixing attachment E1 according to one example was described by taking, as an example, one which has a function to insert and fix the main body to a base T made of gypsum board, such as a ceiling or a wall, by the securing pins 19 . . . ; however, the fixing attachment may also have the following constitution.

The fixing attachment E2 according to other examples is for lock-fixing the main body to a horizontal piece 111 of rail member (non-fixed member) 110, which is arranged on a ceiling or the like and has an inverted T-shape at its cross-section. The fixing attachment E2 is obtained by integrally configuring an engaging piece 91 and attachment main body 90.

The attachment main body 90 is, when interfitted with the above-described openings 17, 17 of the main body B, compartmentally formed by a slanted wall surface 92 flushed with the wall surfaces 12, 13 of the base 10; wall surfaces 93, 93 inscribed with the wall surfaces 14, 14 of the base 10; a bottom wall surface 94; and top wall surface 95, and has a substantially rectangular parallelepiped shape.

On the wall surfaces 93, 93, cylindrical positioning processes 96, 96 (one of these is not shown) having only a required length of projection are formed at positions at which the positioning processes 96, 96 face the above-described positioning holes 18, 18 when the fixing attachment E2 is interfitted with the base 10.

The engaging piece 91 is interfitted with a margin 111*a* of the above-described horizontal piece 111 and has an inverted L-shape when viewed from the side.

By interfitting the fixing attachment E2 having the above-described constitution with the openings 17, 17 of the base 10, both edges of the horizontal piece 111 are each engaged by the engaging pieces 91, 91.

Whereby the main body B1 can be allowed to move along the rail member 110, so that it can also be fixed at an arbitrary position.

Figure 13:
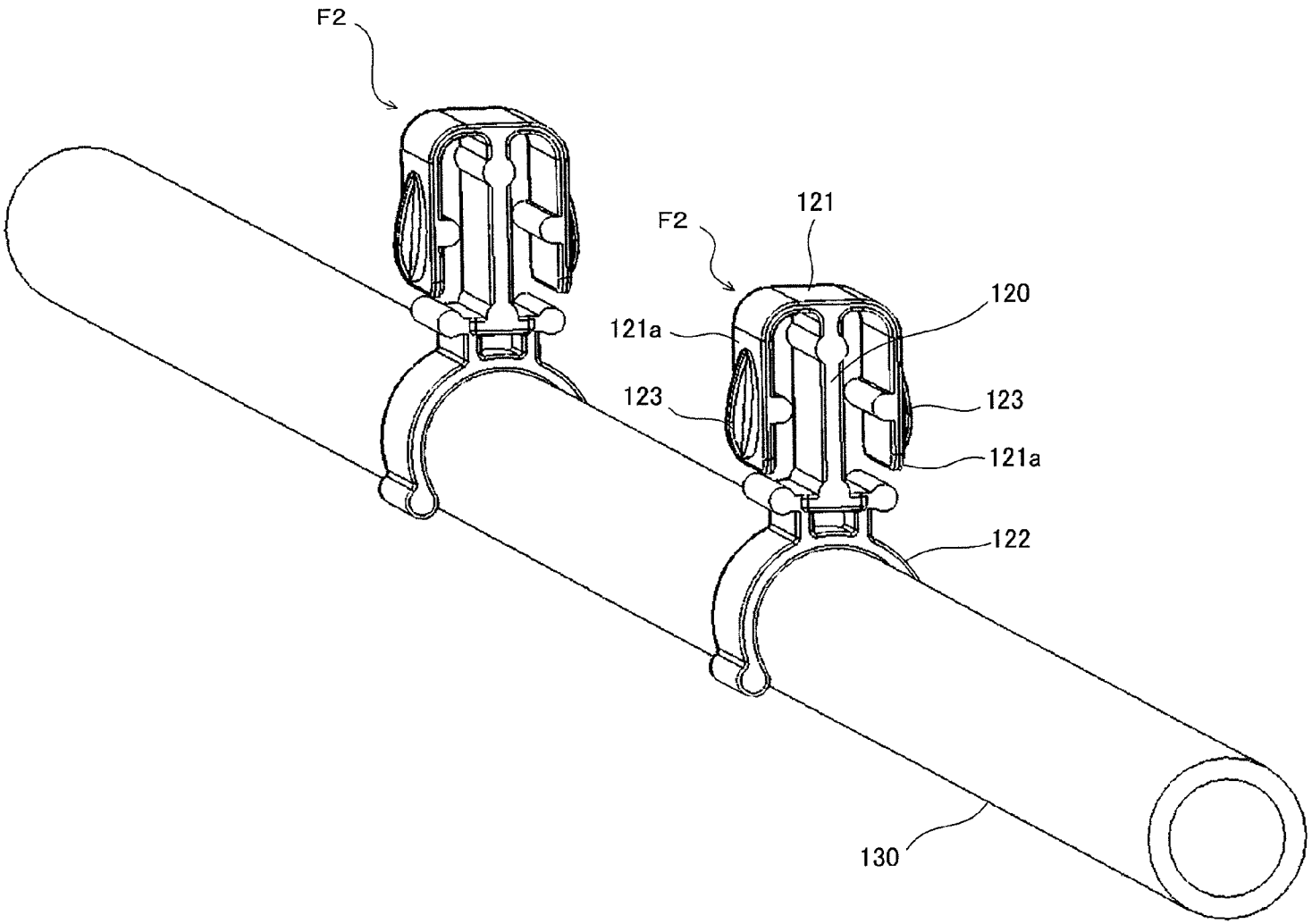
FIG. 13 is a perspective view showing the replacement bracket according to other examples.

FIG. 13 is a perspective view showing the bracket according to other examples.

The bracket F2 according to the other example is integrally formed by two connectors 121, 122 at the top and bottom ends of supporting leg 120 and is made of a synthetic resin.

The connector 121 is configured in an inverted U-shape when viewed from the side, and protrudedly formed on the outer surfaces of dropping portions 121*a*, 121*a* are locking projections 123, 123 which are locked to the connecting hole 65*a* of the above-described connector 62.

The connector 122 is configured in a semicircular shape when viewed from the side in such a manner to elastically clamp a suspending member 130 having a round pipe. Indicated as 124, 124 are guide pieces equivalent to the above-described guide pieces 84, 84.

Figure 14:
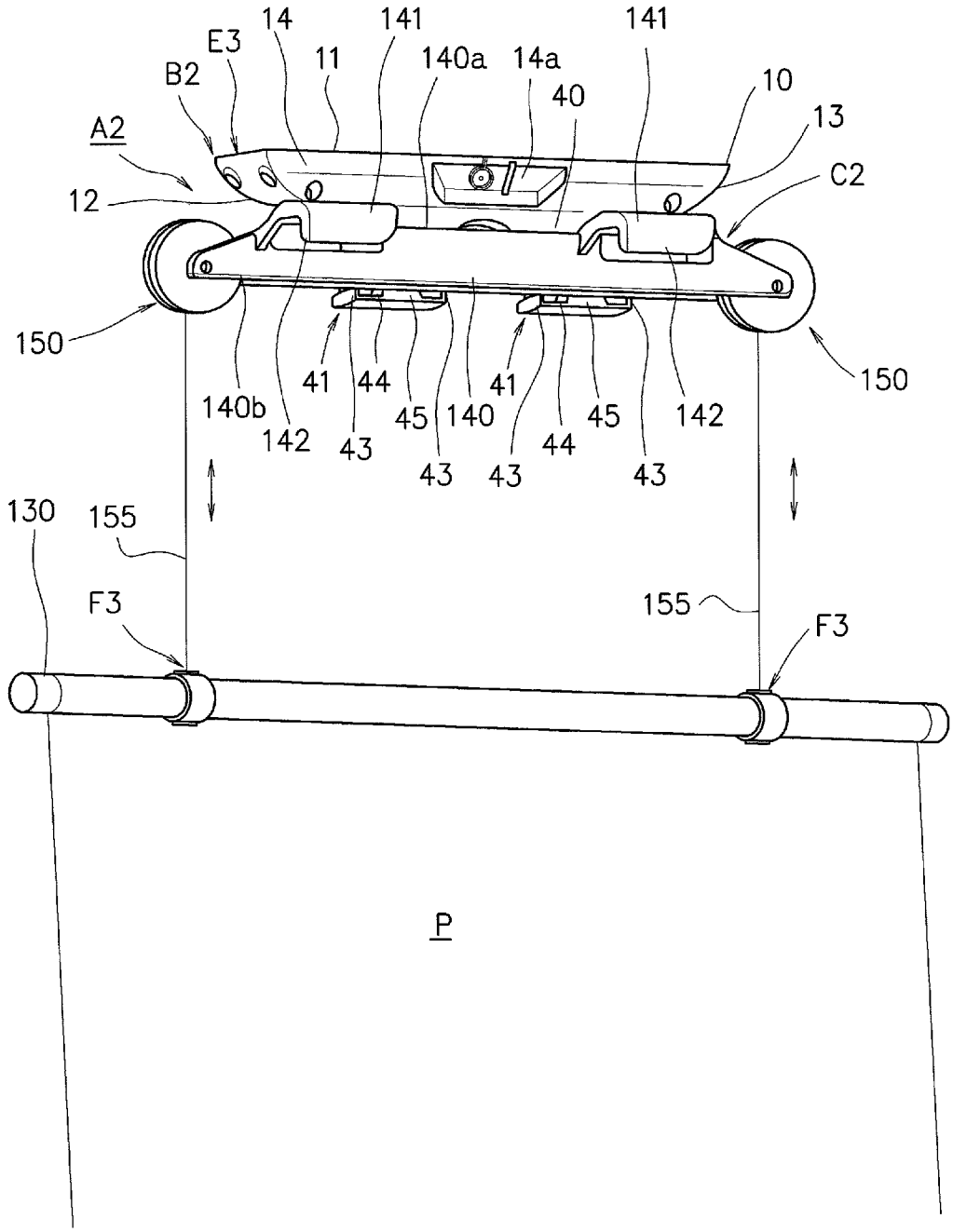
FIG. 14 is a drawing for explaining a condition in which an information displaying medium is suspended by using the suspending unit and the medium holding member according to the second embodiment of the present invention.
Figure 15:
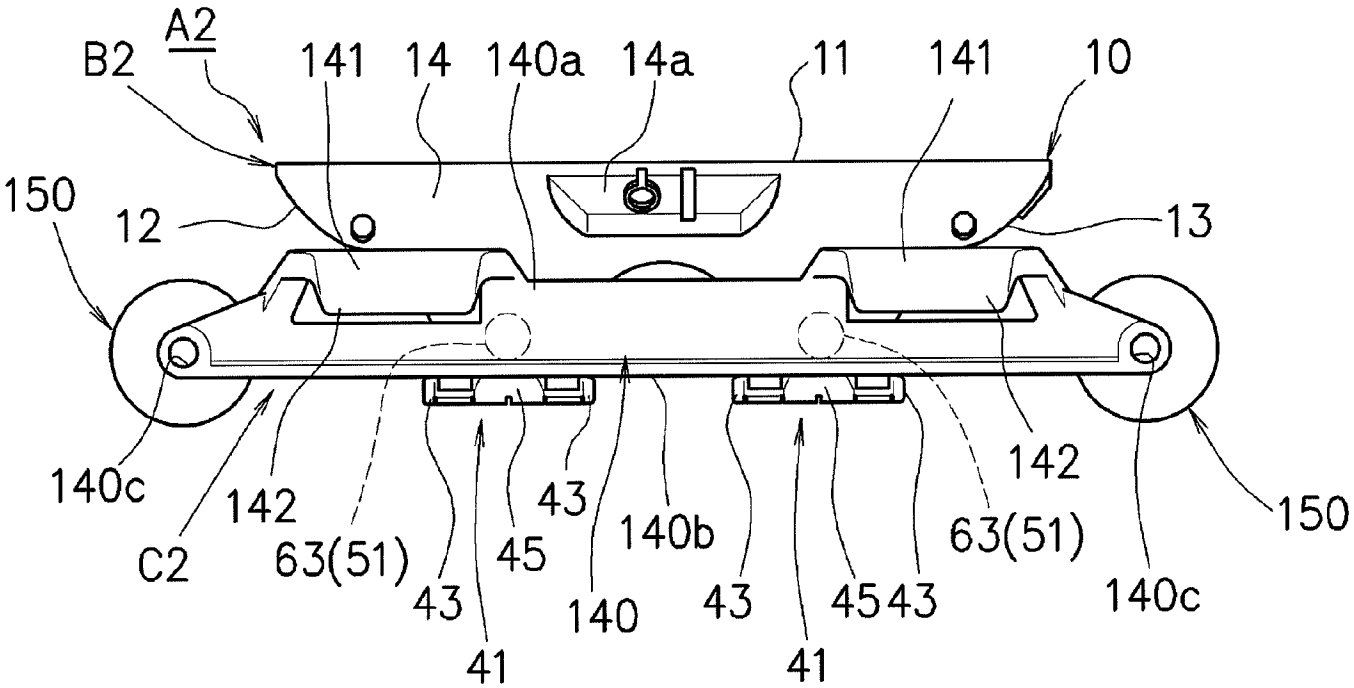
FIG. 15 is an enlarged front view of the same main body and the suspending body mounted thereonto.
Figure 16:
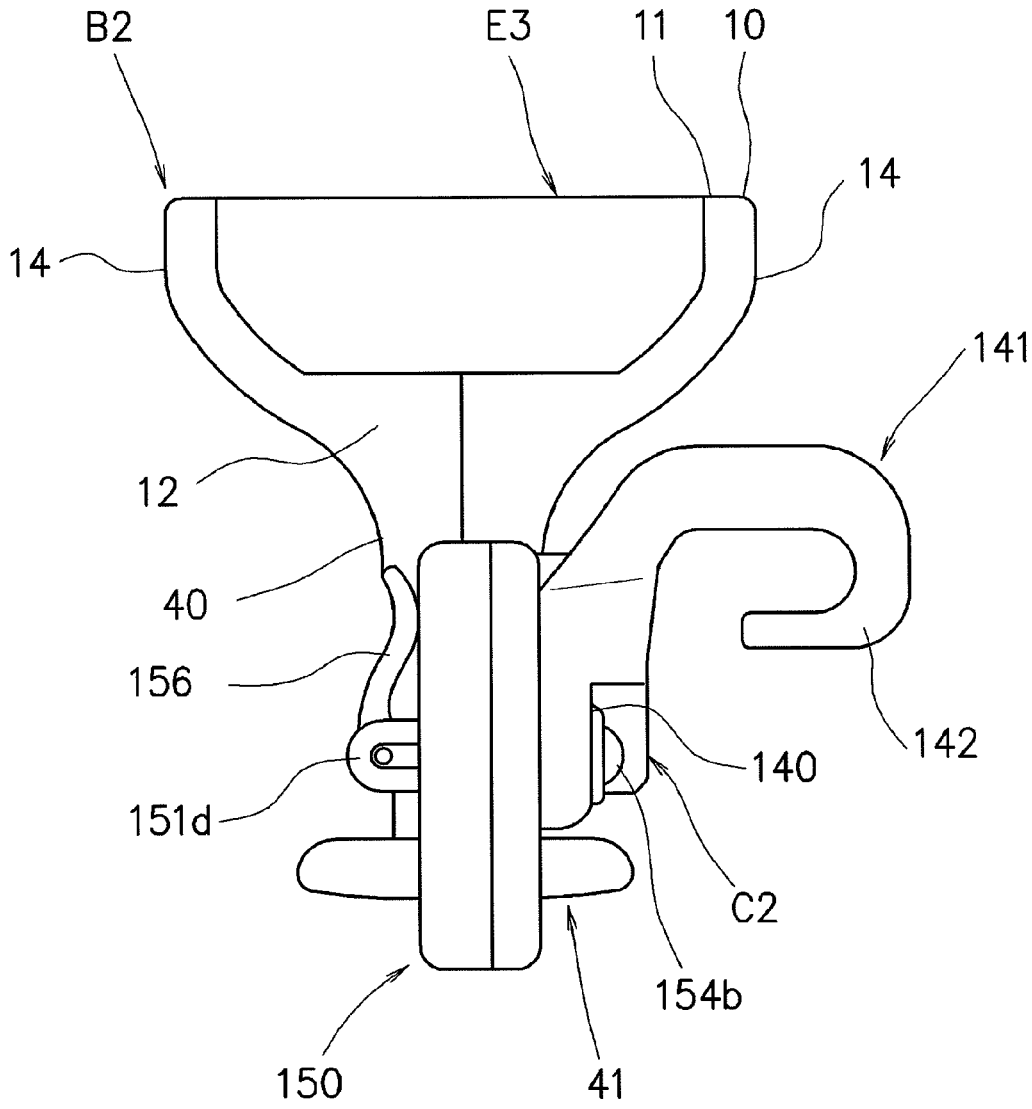
FIG. 16 is a side view of the same main body and the same suspending body.
Figure 17:
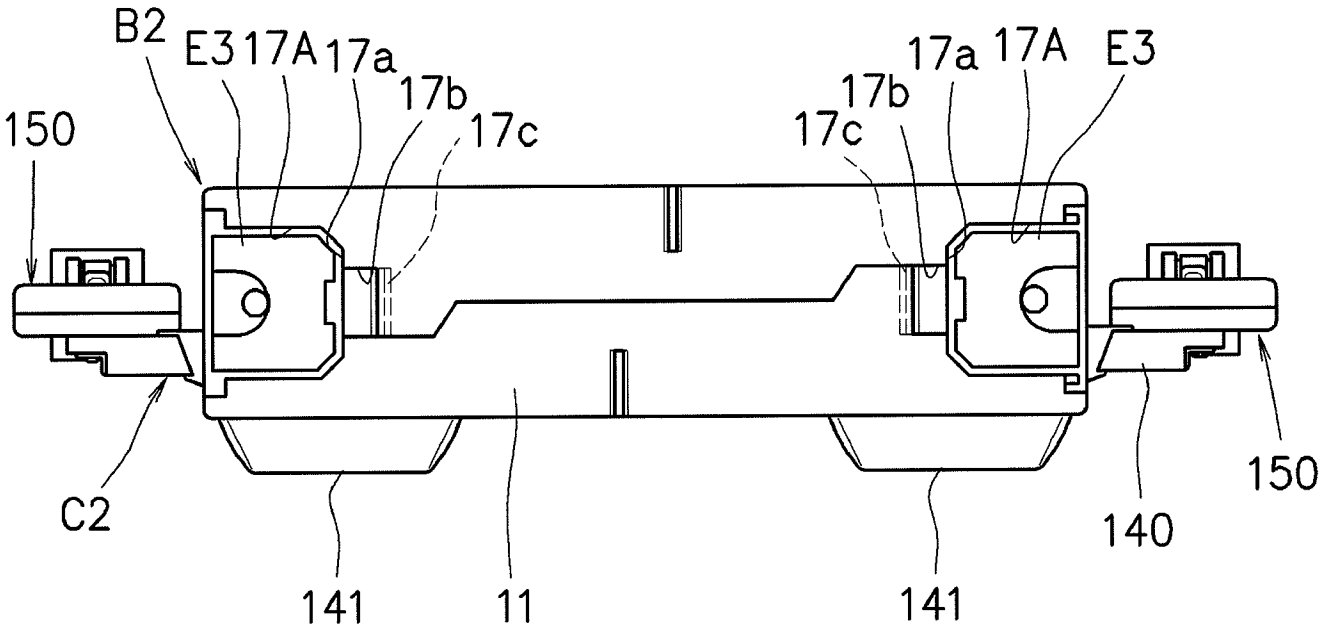
FIG. 17 is a plan view of the same main body and suspending body.
Figure 18:
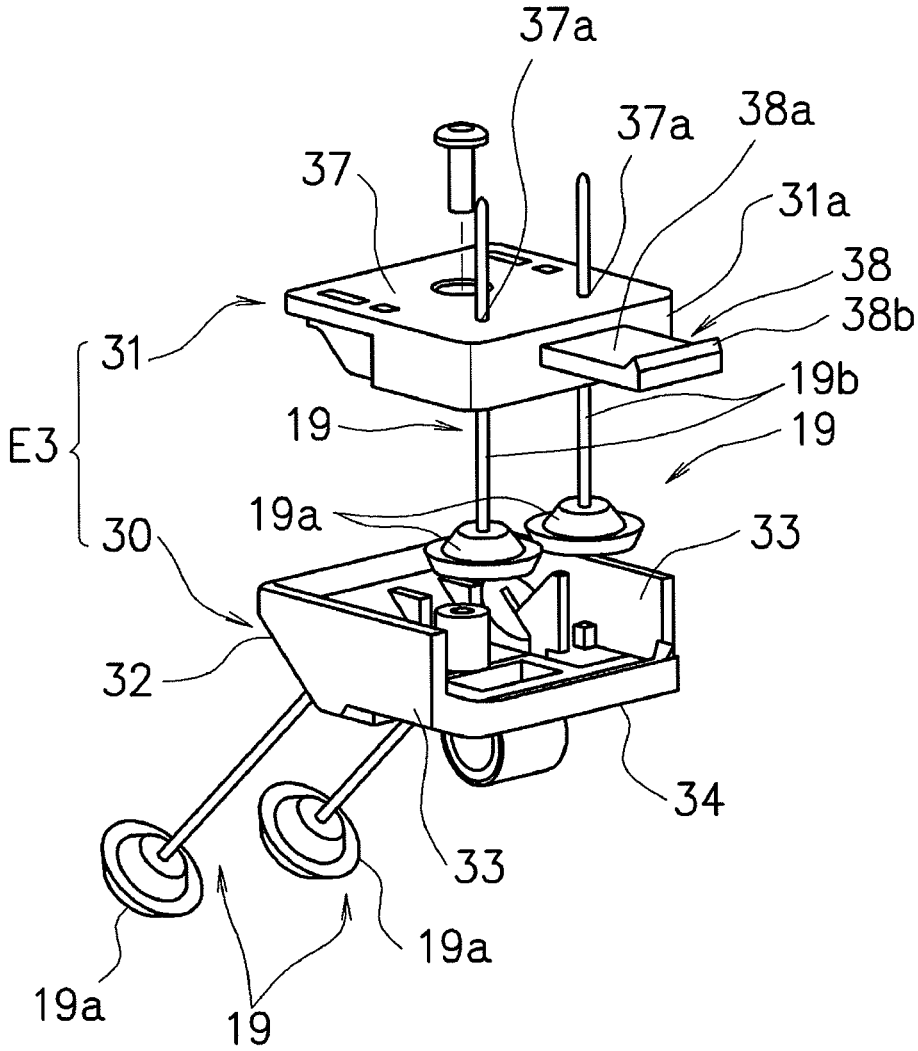
FIG. 18 is an exploded perspective view of the fixing attachment according to other examples.

Next, the suspending unit according to the second embodiment of the present invention will be described referring to FIGS. 14 to 18. FIG. 14 is a drawing for explaining a condition in which an information displaying medium is suspended by using the suspending unit and the medium holding member according to the second embodiment of the present invention. FIG. 15 is an enlarged front view of the main body and the suspending body mounted thereonto, and FIG. 16 is a side view of the main body and the suspending body. Further, FIG. 17 is a plan view of the same main body and suspending body, and FIG. 18 is an exploded perspective view of the fixing attachment according to other examples.

Here, for those parts comparable to the ones explained in the above-described first embodiment, descriptions thereof are omitted by allocating the same symbols. In the following, the differences are primarily described.

The suspending unit A2 according to the second embodiment of the present invention is constituted in such a manner to suspend a suspending member 130 via a suspending string 155 and a bracket F3 from a suspending body C2 according to the second example which is mounted onto the main body B2

Although the main body B2 has an outer shape adopting more curved surfaces compared to the above-described main body B1, the constitution thereof is comparable to that of the main body B1. However, in association with the adoption of the later-described fixing attachment E3 according to the other example, the main body B2 is different from the main body B1 in the installation/removal structure of the fixing attachment E3.

As shown in FIG. 17, at both ends of the base 10, from each of the wall surfaces 12 and 13 to the top wall surface 11, there are formed the openings 17A, 17A having a U-shape when planarly viewed.

On the center of inner edge 17*a* of the opening 17A, an engaging notch 17*b* having a rectangular shape when planarly viewed is formed, and on the bottom surface of the inner edge of the top wall surface 11 demarcating the engaging notch 17*b*, downwardly and protrudedly arranged is an engaging projection 17*c* having an approximately the same length as the width of the inner edged of the engaging notch 17*b*.

As shown in FIG. 18, the fixing attachment E3 is similar to the above-described fixing attachment E1 in that it is constituted by the attachment main body 30 and the cover part 31 and that it is interfitted with the above-described opening 17A in a detachable fashion.

The cover part 31 is a platy body which has a substantially square shape when planarly viewed and is interfitted with the interfitting opening 35 of the attachment main body 30. On the inner wall surface 31*a* of this cover part 31, an engaging member 38 for elastically engaging with the above-described engaging projection 17*c* of the main body B2 is horizontally and protrudedly formed.

The engaging member 38 is integrally formed by an elastically deformable supporting piece 38*a* and an engaging projection 38*b* at the open end of the supporting piece 38*a*, which engaging projection 38*b* engages with the above-described engaging projection 17*c*.

By inserting the fixing attachment E3 to the main body B2 utilizing elastic deformation of the supporting piece 38*a*, an engagement between the main body engaging projections 17*c* and 38*b* is achieved. In addition, by pulling the fixing attachment E3 toward a lateral position of the main body B2, the supporting piece 38*a* is elastically deformed and the engagement between the main body engaging projections 17*c* and 38*b* is released, thereby enabling an easy detachment.

The suspending body C2 is constituted by a basal body 140 having a transversely elongated rectangular shape; detachment parts 141, 141 formed near both ends of the upper edge 140*a* of the basal body 140; suspending length adjusting parts 150, 150 arranged on both ends of the basal body 140; and magnetic bodies 63, 63.

The detachment parts 141, 141 correspond to the above-described detachment parts 61, 61, and function to allow an external force to effect against the magnetic attraction force between the main body-side magnetic bodies 51 and the suspending body-side magnetic bodies 63, which are arranged on the main body B2 and the suspending body C2, respectively, so that the suspending body C2 is detached from the suspending body holding section 40

Specifically, formed on the detachment parts 141, 141 are laterally J-shaped locking pieces 142, 142 having a lateral rectangular shape when viewed from the front, which locking pieces 142, 142 are used to insert and lock the locking bar 103 (see FIG. 9) of the above-described replacing equipment 100 at the upper end of the detachment parts 141, 141.

That is, as shown in FIG. 1(B), the above-described locking pieces 142, 142 are positioned in such a manner that, by at least effecting an external force in the downward direction (downward external force) F, rotary forces in the clockwise and the counter-clockwise directions are generated on the suspending body C2 (C2) with the contact points between the above-described contact pieces 43, 44, 44, 43 and the lower edge 140*b* of the basal body 140 of the suspending body C2 as the rotation axes O4, O5.

Figure 19:
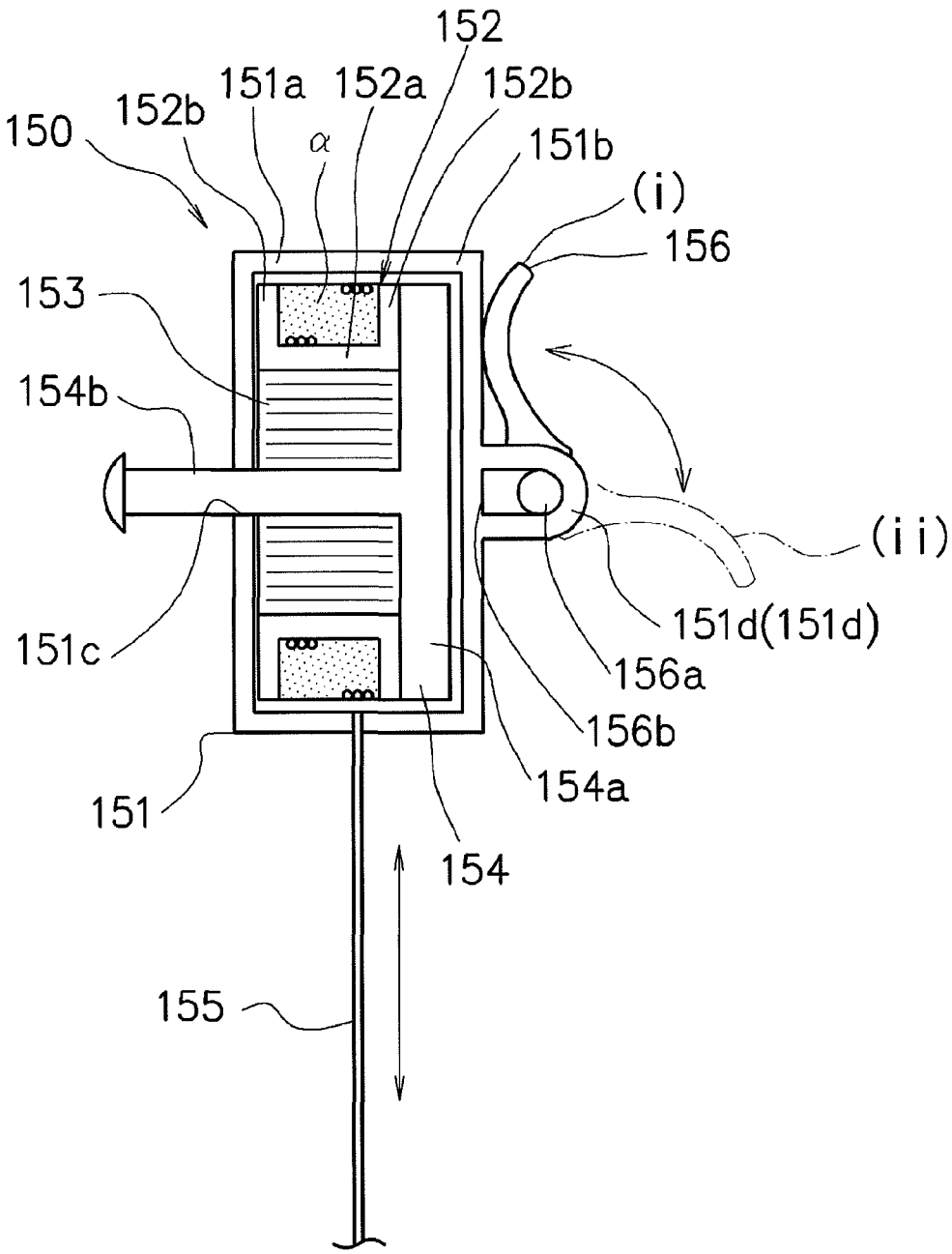
FIG. 19 is an enlarged cross-sectional view of the suspending length adjusting part.

FIG. 19 is an enlarged cross-sectional view of the suspending length adjusting part.

The suspending length adjusting parts 150, 150 are used to adjust the length of the suspending string 155 and are attached to bearing holes 140*c*, 140*c* arranged at both ends of the basal body 140.

That is, as shown in FIG. 19, the suspending length adjusting part 150 houses in a case 151 a reel 152, a spiral spring 153, a rotation stopping member 154 and the suspending string 155, and is constituted in such a manner that a rotation stopping lever 156 is provided on one wall surface of the case 151.

The case 151 is configured in a cylindrical shape by allowing the sections 151*a*, 151*b*, which have an opening on one surface and have the same outer diameter, to contact at the opening, and there is arranged an axis hole 151*c* at the center of the section 151*a*.

The rotation stopping member 154 is used to stop the rotation of the reel 152. The rotation stopping member 154 is integrally and protrudedly arranged with an axis 154*b* on the center of a discoid sliding contact plate 154*a* and supports the axis 154*b* in the above-described bearing hole 151*c* in a freely rotatable manner.

The reel 152 is configured to have, on its circumference, a toric string housing groove α for reeling and housing a required length of the suspending string 155 by integrally protrudedly arranging circular flange portions 152*b*, 152*b* on both surfaces of cylindrical winding part 152*a*.

Here, one end of the suspending string 155 is connected to a part of the reel 152.

The spiral spring 153 is reeled and housed in a hollow spring housing part α which is formed in a cylindrical shape in the winding part 152*a*. One end of the spiral spring 153 is fixed on the reel 152 and the other end is fixed on the axis 154*b*.

That is, by reeling and tightening the spiral spring 153 in association of withdrawal of the suspending string 155, the suspending string 155 is pulled in when the withdrawal of the suspending string 155 is released.

On the center of the outer wall surface of the section 151*b*, a pair of axis supporting pieces 151*d*, 151*d* (one of these is not shown) is protrudedly arranged for supporting the axis 156*a* of the rotation stopping lever 156. Further, a contact part 156*b* is offsetly formed in an evaginating fashion around the axis 156*a*.

That is, by turning the rotation stopping lever 156 between a rotation stopping position (i) and a rotation allowing position (ii), the inner wall surface of the section 151*b* is elastically deformed to come into contact with the rotation stopping member 154, and at the same time, by bringing the sliding contact plate 154*a* into contact with the reel 152 by pressing, the rotation of the reel 152 can be stopped.

That is, it is made such that the suspending string 155 can be retained in a condition in which only a desired length thereof is withdrawn. In other words, the length of the withdrawn suspending string 155 is adjustable.

Figure 20A:
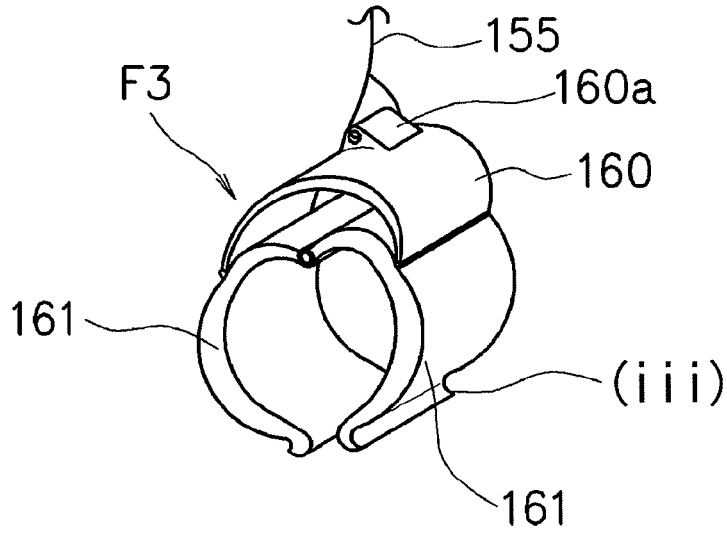
FIGS. 20(A) and (B) are, respectively, a perspective view and a side view showing the bracket according to other examples.
Figure 20B:
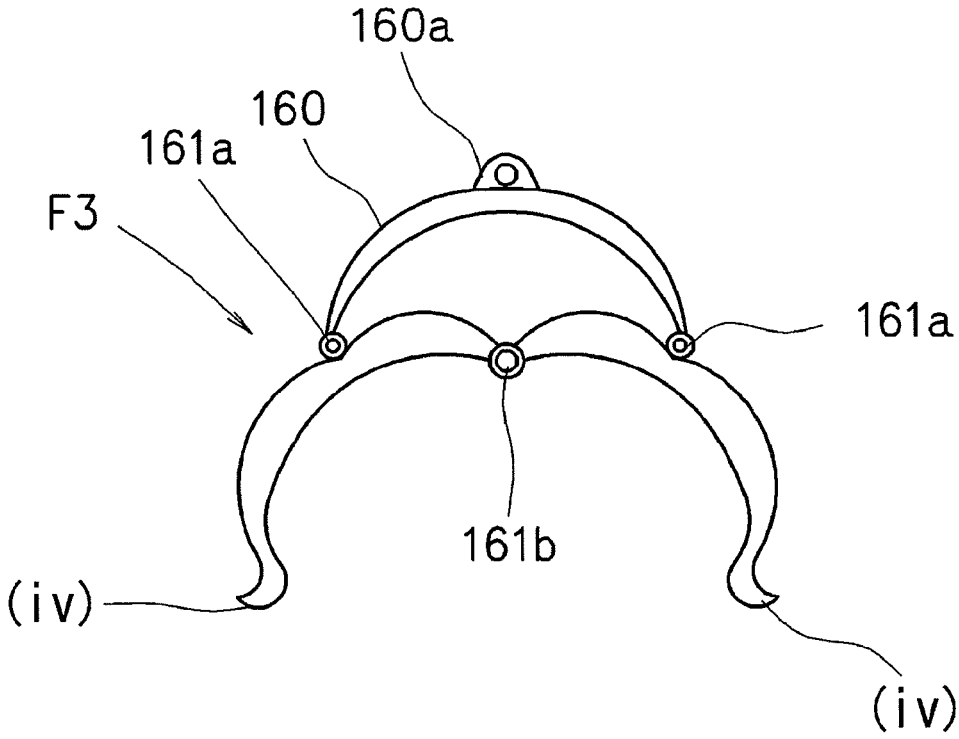

Fixed at the other end (the lower end) of the suspending string 155 is the bracket according to other examples. FIGS. 20(A) and (B) are, respectively, a perspective view and a side view showing the bracket according to other examples.

The bracket F3 according to the other example is constituted by an elastic member 160 and clamping member 161, 161 and is made of a synthetic resin.

The elastic member 160 is configured in a substantially inverted C-shape when viewed from the side and utilized to elastically hold the later-described clamping members 161, 161 at a clamping position (iii) and a non-clamping position (iv). Protrudedly arranged at the center of the outer wall surface of the elastic member 160 is a string connector 160*a* to which the lower end of the suspending string 155 is connected.

The clamping members 161, 161 are configured in a circular-arc shape when viewed from the side to clamp the above-described suspending member 130. The clamping members 161, 161 are connected with both ends of the elastic member 160 at the central part of the peripheral surface by hinges 161*a*, 161*a*, and the basal ends of the clamping members 161, 161 are connected by a hinge 161*b*.

With the suspending unit A2 having the above-described constitution, in addition to the effects obtained by the suspending unit A1, since the withdrawing length of the suspending strings 155, 155 can be individually adjusted by the respective suspending length adjusting parts 150, 150, the tilt of the information displaying medium P can be easily corrected.

Figure 21:
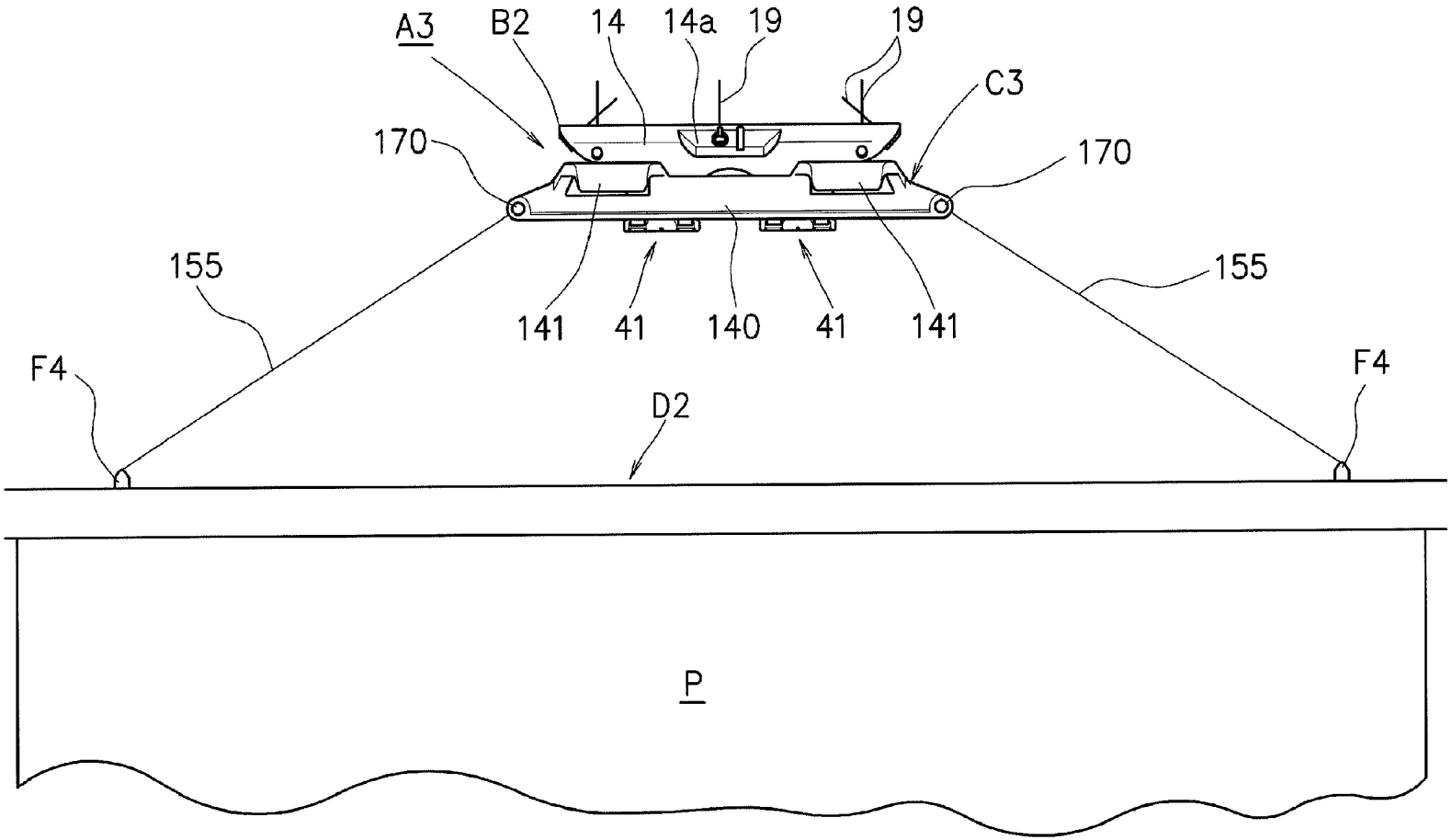
FIG. 21 is an explanatory drawing showing the condition in which an information displaying medium is suspended by using the suspending unit and the medium holding member according to the third embodiment of the present invention.
Figure 22A:
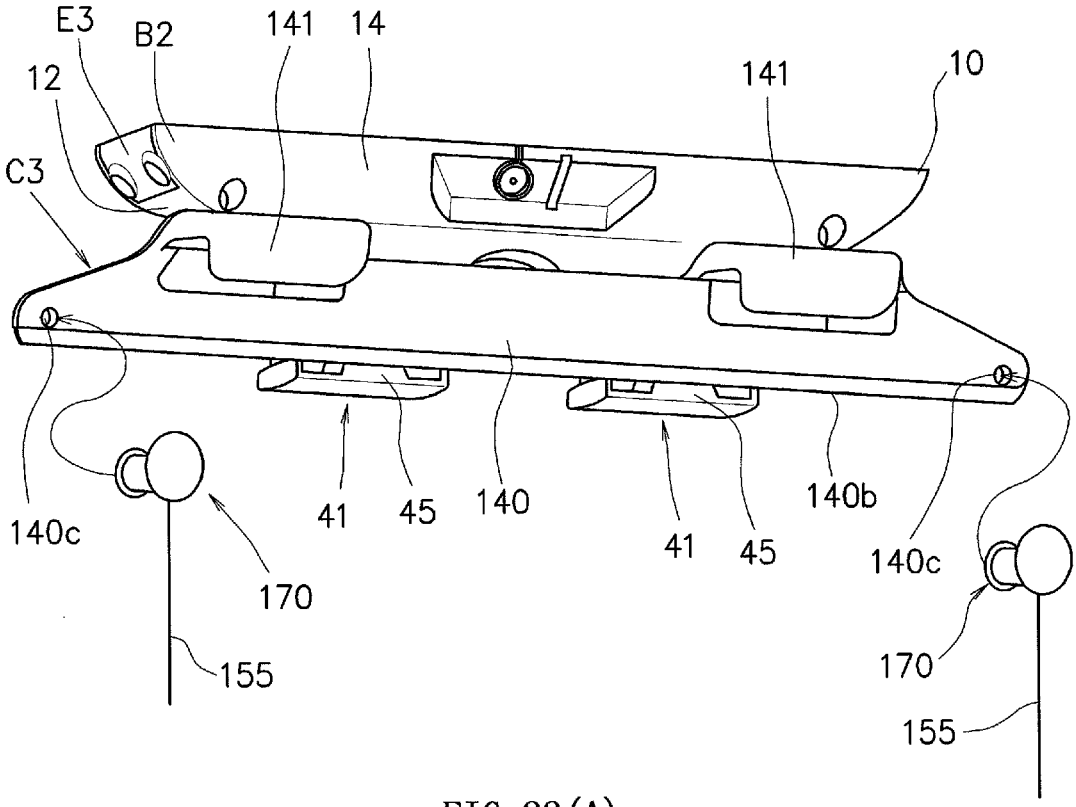
FIG. 22(A) is a perspective view showing the suspending body according to the third example which is mounted on the main body.
Figure 22B:
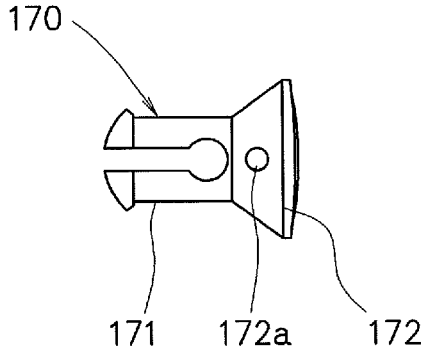
FIG. 22(B) is an enlarged side view of the string fixing member arranged on the suspending body according to the third example.

Next, the suspending unit according to the third embodiment of the present invention will be described referring to FIGS. 21 to 25. FIG. 21 is an explanatory drawing showing the condition in which an information displaying medium is suspended by using the suspending unit and the medium holding member according to the third embodiment of the present invention. FIG. 22(A) is a perspective view showing the suspending body according to the third example which is mounted on the main body, and FIG. 22(B) is an enlarged side view of the string fixing member arranged on the suspending body according to the third example.

Figure 23:
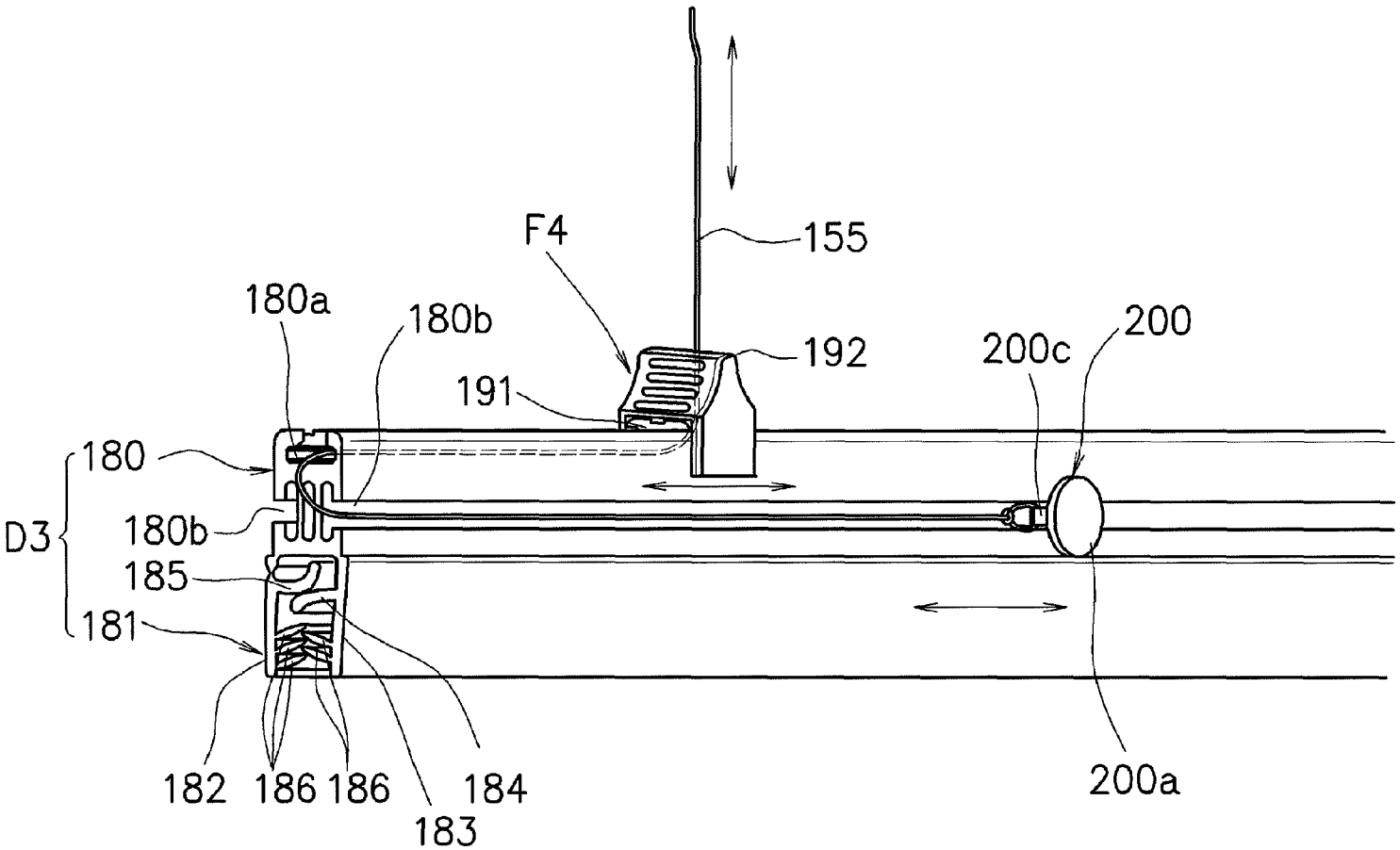
FIG. 23 is a partially enlarged perspective view showing the details of the medium holding member, the sliding bracket and the slider.
Figure 24:
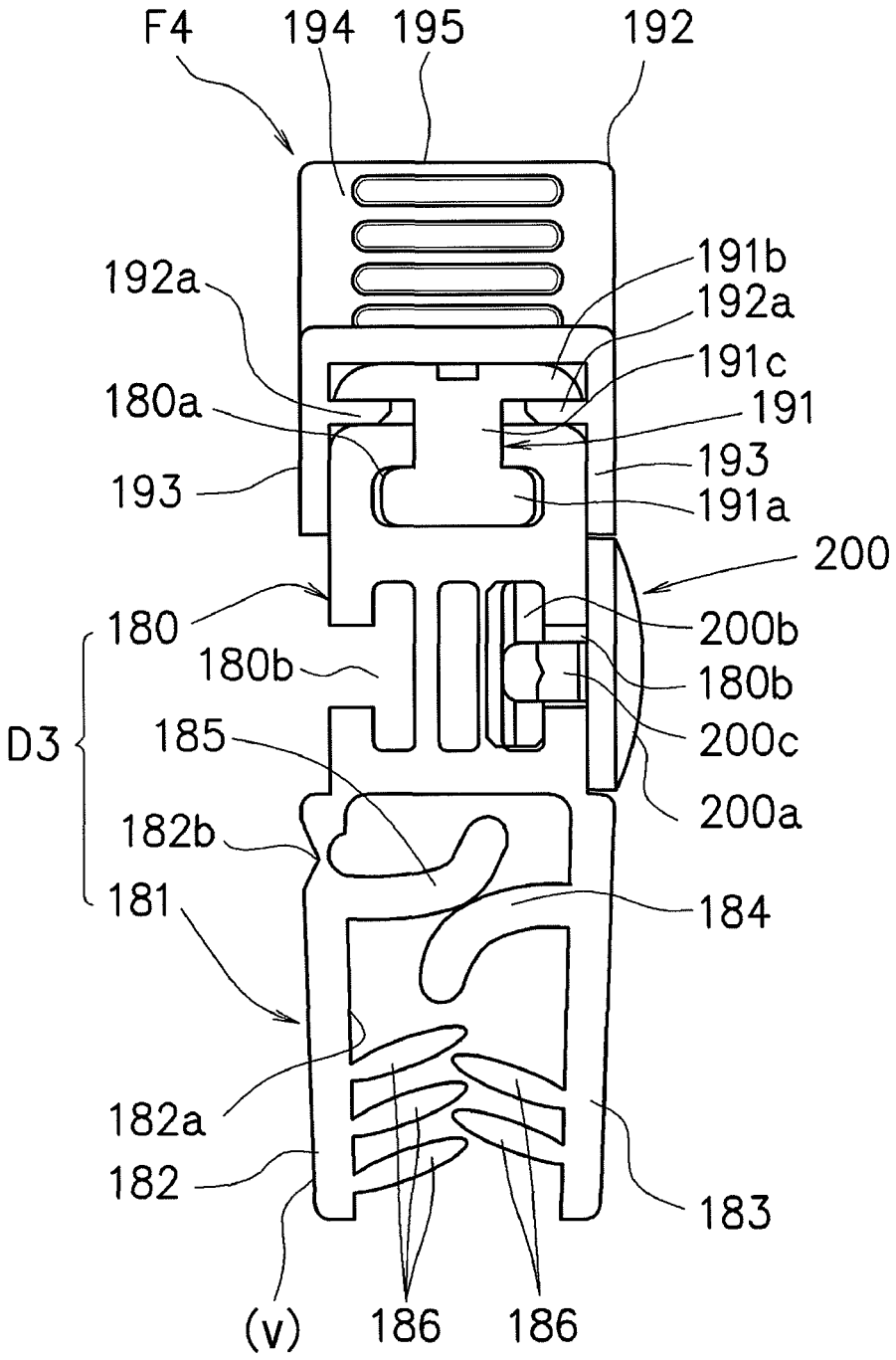
FIG. 24 is an enlarged side view of the same medium holding member, sliding bracket and slider.
Figure 25:
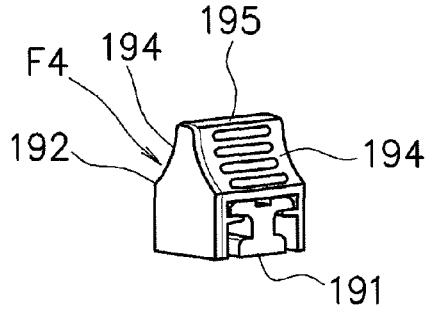
FIGS. 25(A), (B) and (C) are, respectively, a perspective view, cross-sectional view and exploded view of the sliding bracket.
Figure 25:
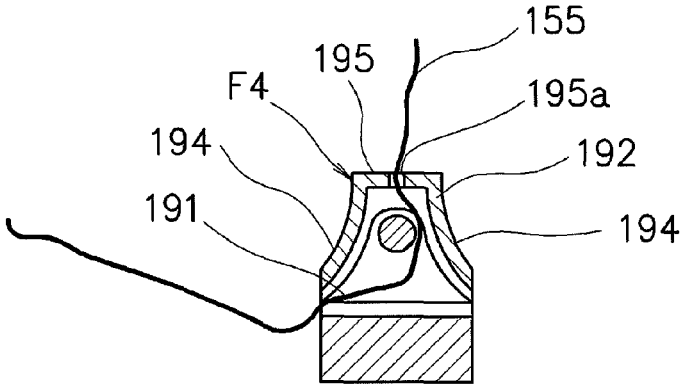
Figure 25:
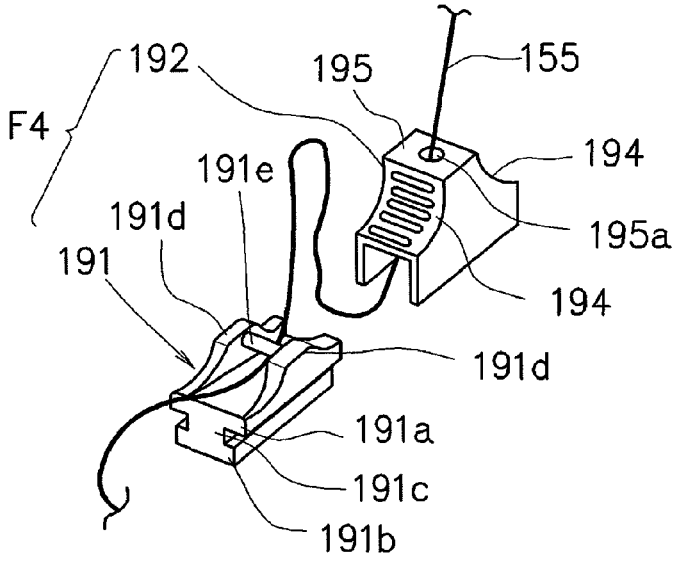

Further, FIG. 23 is a partially enlarged perspective view showing the details of the medium holding member, the sliding bracket and the slider, and FIG. 24 is an enlarged side view of the medium holding member, the sliding bracket and the slider. FIGS. 25(A), (B) and (C) are, respectively, a perspective view, cross-sectional view and exploded view of the sliding bracket.

The suspending unit A3 according to the third embodiment of the present invention is principally constituted by the main body B2, a suspending body C3 and a medium holding member D2, and the medium holding member D2 is suspended from the suspending body C3 via the bracket F3 and the suspending string 155.

Here, since the suspending unit A3 according to this embodiment is different from the above-described suspending unit A2 in the constitutions of the suspending body C3 and the medium holding member D3, the differences will be described in the following. For those parts comparable to the ones explained in the other above-described embodiments, descriptions thereof are omitted by allocating the same symbols.

The suspending body C3 according to the third example has a constitution in which, in place of the suspending length adjusting parts 150, 150 provided on the suspending body C2 of the above-described suspending unit A2, string fixing members 170, 170 are arranged and a bracket F4 is adopted in place of the bracket F3.

As shown in FIGS. 22(A) and (B), the string fixing member 170 is integrally formed by an axis portion 171 which is inserted and locked into a bearing hole 140*a* and around which a desired length of the upper end of the suspending string 155 is wound; and a string bearing part 172 having a larger diameter than the axis portion 171. On the string bearing part 172 is formed an inserted-through hole 172*a* for supporting by inserting through the suspending string 155 wound around the axis portion 171.

As shown in FIGS. 23 and 24, the medium holding member D2 according to the second embodiment is integrally configured such that a groove forming part 180 and a clamping part 181 are arranged in the upper half and the lower half, respectively, and in such a manner to have a total length corresponding to the width of the information displaying medium P.

The groove forming part 180 is configured in a substantially T-shape when viewed from the side by formation of a bracket engaging groove 180*a* on the upper part, which bracket engaging groove 180*a* has a T-shape when viewed from the side and is used to engage a bracket F4 later described in detail in a freely slidable fashion, as well as by formation of slider engaging grooves 180*b*, 180*b* on both sides, which is used to engage a slider 200 for adjusting the length of the suspending string 155 in a freely slidable fashion.

The clamping part 181 is configured in such a manner that a flexible piece 182, which is connected to one side of the edge of the groove forming part 180 via a hinge 182*b*, and a fixed piece 183, which is integrally formed on the other side of the edge of the groove forming part 180, are facing each other.

The flexible piece 182 is rotatable between a clamping position (v) where the information displaying medium P is clamped and a non-clamping position (not shown) where the flexible piece is outwardly opened from the clamping position (v).

On the upper end of the inner surface 182*a* of the flexible piece 182, an engaging projection 185, which is engaged with an engaging projection 184 formed on the upper end of the fixed piece 183 when the flexible piece 182 is moved into the clamping position (v), is protrudedly formed toward the fixed piece 183.

By allowing the engaging projections 184, 185 to engage with each other, a condition in which the information displaying medium P is clamped by the flexible piece 182 and the fixed piece 183 is maintained.

By allowing the engaging projections 184, 185 to engage with each other, not only the flexible piece 182 can be positioned and fixed at the clamping position (v), but also the information displaying medium P inserted between the later-described clamping projections 186, 185 . . . can be clamped firmly.

In addition, from the central part to the lower part of the inner surface 182*a* of the flexible piece 182, clamping projections 186 . . . for clamping the information displaying medium P are protrudedly formed in multiple-layer.

Also from the central part to the lower part of the fixed piece 183, clamping projections 186 . . . for clamping the information displaying medium P are protrudedly formed in multiple-layer.

Each clamping projection 186 is slantly arranged with the open end positioned higher than the fixed end, thereby increasing the clamping power by the weight of the information displaying medium P itself.

The bracket 4 is constituted by a connector 191 which is engaged with the bracket engaging groove 180*a* in a freely slidable fashion and has a T-shape when viewed from the side; and an exterior body 192 which covers the connector 191.

Arranged on the upper and lower end of the connector 191 are a lower-side engaging part 191*a*, which is engaged into the bracket engaging groove 180*a*, and an upper-side engaging part 191*b*, which is engaged with the engaging pieces 192*a*, 192*a* of the exterior body 192, respectively. Further, as shown in 25, a pair of supporting pieces 191*d*, 191*d* is vertically arranged on both sides of the top surface of the upper-side engaging part 191*a*, and a guide member 191*e* is installed in a bridging fashion to direct the suspending string 155 between the supporting pieces 191*d*, 191*d*.

With regard to the exterior body 192, the above-described locking pieces 192*a*, 192*a* are protrudedly arranged on the inner wall surface of side plates 193, 193 having a space therebetween to sandwich the groove formation part 180, and the upper walls 194, 195, 194 are configured in a mountain shape on the upper half side of the side plates 193, 193. On the upper wall 195, a drawstring hole 195*a* (see FIG. 25) is formed for passing the suspending string 155 therethrough.

In the above-described constitution, the lower end of the suspending string 155 is passed though the drawstring hole 195*a* of the exterior body 192, the guide member 193, the bracket sliding groove 180*a* and the slide engaging groove 180*b*, before being connected and fixed to the slider 200.

As shown in FIGS. 23 and 24, the slide 200 is constituted by operating part 200*a* having a larger diameter than the width of the slider engaging groove 180*b* and engaging part 200*b* engaged into the slider engaging, which are integrally connected by a connector 200*c*.

On the connector 200*c*, a string hole (not shown) is formed to connect the other end of the suspending string 155.

With the suspending unit A3 according to this embodiment having the above-described constitution, by allowing the slider 200 to slide along the sliding groove 180*b*, the length of the suspending string 155 can be adjusted.

In this embodiment, the suspending length adjusting part for adjusting the length of the suspending string 155 is constituted by the bracket F4 and the slider 200.

With the above-described suspending unit A3, in addition to the effects obtained by the suspending unit A1, since the withdrawing length of the suspending strings 155, 155 can be adjusted by the slider 200, the tilt of the information displaying medium P can be easily corrected.

In addition, since the length adjusting operation can be carried out in the vicinity of the medium holding member D3, the operation can be easily carried out at a lower position.

Figure 26:
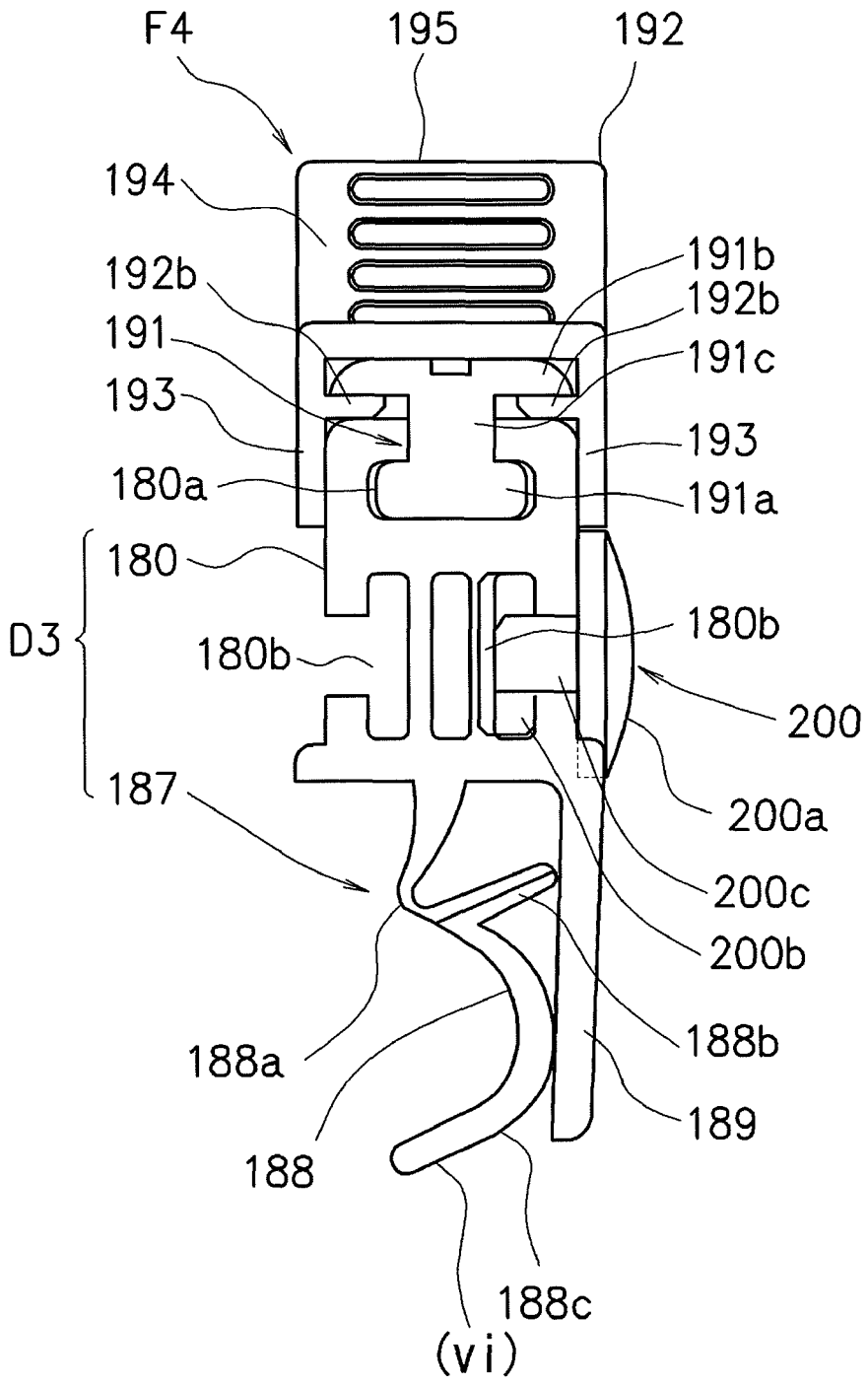
FIG. 26 is an enlarged side view of the medium holding member according to the third embodiment.

The medium holding member according to the third embodiment will now be described referring to FIG. 26. FIG. 26 is an enlarged side view of the medium holding member according to the third embodiment. Here, for those parts comparable to the ones explained in the above-described medium holding member D2, descriptions thereof are omitted by allocating the same symbols.

The medium holding member D3 according to the third embodiment is integrally configured such that the groove forming part 180 and a clamping part 187 are arranged in the upper half and the lower half, respectively, and in such a manner to have a total length corresponding to the width of the information displaying medium P.

The clamping part 187 is configured in such a manner that a flexible piece 188, which is connected to the central part of the groove forming part 180 via a hinge 188*a*, and a fixed piece 189, which is integrally formed on the other side of the edge of the groove forming part 180, are facing each other.

The flexible piece 188 is rotatable between a clamping position (vi) where the information displaying medium P is clamped and a non-clamping position (not shown) where the flexible piece is outwardly opened from the clamping position (vi).

On the middle part of the inner surface 188*c* of the flexible piece 188, an engaging projection 188*b*, which is engaged with a fixed piece 189 when the flexible piece 188 is moved into the clamping position (vi), is protrudedly formed toward the fixed piece 189.

By allowing the engaging projection 188*b* to engage with the fixed piece 189, a condition in which the information displaying medium P is clamped by the flexible piece 188 and the fixed piece 189 is maintained.

It should be noted here that the present invention is not limited to the above-described embodiments, and the present invention can be carried out with the following modifications.

In the above-described embodiments, examples in which the magnetic bodies are arranged at the positioning parts of both the main body and the suspending body were described; however, it is also acceptable to have a constitution in which a magnetic material is arranged on the suspending body in place of the magnetic bodies or in which a magnetic material is arranged on the main body in place of the magnetic bodies.

In the above-described embodiments, the constitution in which the positioning pins are engaged into the pin-engaging holes formed on the cover part was described while showing the fixing attachment constituted by the attachment main body and the cover part; however, the positioning pins may be insert-molded to the above-described cover part.

In addition, although a constitution in which the attachment main body and the cover part are formed in a separate body was shown, they may be integrated.

Though detailed descriptions are provided in the above, in any case, the constitutions described in each of the above-described embodiments are not limited to be applied in the respective embodiments. It is noted here that the constitution described in one embodiment may be applied mutatis mutandis or adopted in other embodiments and that the constitutions may be arbitrary combined.

DESCRIPTION OF SYMBOLS

40 Suspending body holding section
42 Fall-off preventing piece
50, 66 Positioning parts
51 Main body-side magnetic bodies
63 Suspending body-side magnetic bodies
61 Detachment part
70 Connecting piece
71, 189 Fixed pieces
72, 188 Flexible pieces
78, 186 Clamping projections
A1 to A3 Suspending units
B1, B2 Main bodies
C1 to C3 Suspending bodies
D1 to D3 Medium holding members
P Information displaying medium
T Base

The invention claimed is:

1. A suspending unit for suspending an information displaying medium expressing a required information from a base, said suspending unit comprising:

a main body which is fixed on said base, and a suspending body which suspends said information displaying medium and is supported by said main body in a freely detachable fashion, wherein said main body being configured with a suspending body holding section which prevents downward movement of said suspending body and holds said suspending body in a freely detachable fashion, one or a plurality of main body-side magnetic bodies are arranged facing said suspending body held by said suspending body holding section;

said suspending body being arranged with suspending body-side magnetic bodies at positions where said suspending body-side magnetic bodies face the respective main body-side magnetic bodies arranged on said main body, said suspending body-side magnetic bodies attaching to said main body-side magnetic bodies, a detachment part is configured in such a manner to effect an external force against the magnetic attraction force between said main body-side magnetic body and said suspending body-side magnetic body arranged on said main body and suspending body, respectively, so that said suspending body is detached from said suspending body holding section, and a fall-off preventing piece is arranged on said suspending body holding section to prevent said suspending body retained thereby from falling off.

2. A suspending unit according to claim 1, wherein a plurality of said main body-side magnetic bodies and said suspending body-side magnetic bodies are arranged on said main body and suspending body, respectively, and said arranged main body-side magnetic bodies and said arranged suspending body-side magnetic bodies are disposed in such a manner to have different polarities.

3. A suspending unit according to claim 1, wherein a positioning part is formed on both said main body and suspending body to position said suspending body on said suspending body holding section.

4. A suspending unit according to claim 1, wherein said main body-side magnetic bodies and said suspending body-side magnetic bodies are arranged at said positioning part of both said main body and said suspending body.

5. A suspending unit according to claim 1, wherein said suspending body holding section retains said suspending body in a freely tiltable and detachable fashion.

6. A suspending unit according to claim 1, wherein a required gap is formed between said suspending body retained by said suspending body holding section and said fall-off preventing piece.

7. A suspending unit according to claim 6, wherein a plurality of said main body-side magnetic bodies and said suspending body-side magnetic bodies are arranged on said main body and suspending body, respectively, and said arranged main body-side magnetic bodies and said arranged suspending body-side magnetic bodies are disposed in such a manner to have different polarities.

8. A suspending unit according to claim 6, wherein a positioning part is formed on both said main body and suspending body to position said suspending body on said suspending body holding section.

9. A suspending unit according to claim 6, wherein said main body-side magnetic bodies and said suspending body-side magnetic bodies are arranged at said positioning part of both said main body and said suspending body.

10. A suspending unit according to claim 6, wherein said suspending body holding section retains said suspending body in a freely tiltable and detachable fashion.

11. A suspending unit for suspending an information displaying medium expressing a required information from a base, said suspending unit comprising:

a main body which is fixed on said base, and a suspending body which suspends said information displaying medium and is supported by said main body in a freely detachable fashion, wherein said main body being configured with a suspending body holding section which prevents downward movement of said suspending body and holds said suspending body in a freely detachable fashion, one or a plurality of main body-side magnetic bodies are arranged facing said suspending body held by said suspending body holding section;

said suspending body being arranged with suspending body-side magnetic bodies at positions where said suspending body-side magnetic bodies face the respective main body-side magnetic bodies arranged on said main body, said suspending body-side magnetic bodies attaching to said main body-side magnetic bodies, and a detachment part is configured in such a manner to effect an external force against the magnetic attraction force between said main body-side magnetic body and said suspending body-side magnetic body arranged on said main body and suspending body, respectively, so that said suspending body is detached from said suspending body holding section, a connector is arranged on said suspending body, said connector being used to connect a bracket which supports a medium holding member for holding an information displaying medium, wherein said medium holding member is arranged with a flexible piece and a fixed piece facing each other with a required space therebetween, said flexible piece being movable between a clamping position where an information displaying medium is clamped and a non-clamping position where said information displaying medium is not clamped, and a plurality of clamping projections are protrudedly arranged on each of the surfaces of said flexible piece and said fixed piece facing each other, said clamping projections being used to clamp said information displaying medium.

12. A suspending unit according to claim 11, wherein said medium holding member is arranged with a pair of flexible pieces facing each other and a fixed piece therebetween with a required space between each of said flexible piece and said fixed piece, said flexible pieces being movable between a clamping position where an information displaying medium is clamped and a non-clamping position where said information displaying medium is not clamped, and a plurality of clamping projections are protrudedly arranged on each of the surfaces of said flexible pieces and said fixed piece facing each other, said clamping projections being used to clamp said information displaying medium.

13. A suspending unit according to claim 11 wherein said bracket for holding an information displaying medium is suspended from said suspending body via a suspending string, and a suspending length adjusting part is arranged for adjusting the length of said suspending string.

14. A suspending unit according to claim 12, wherein said bracket for holding an information displaying medium is suspended from said suspending body via a suspending string, and a suspending length adjusting part is arranged for adjusting the length of said suspending string.

* * * * *